US007366436B2

(12) United States Patent
Akiyama et al.

(10) Patent No.: US 7,366,436 B2
(45) Date of Patent: Apr. 29, 2008

(54) PROCESSING UNIT HAVING A PANEL SUPPORTED MOVABLY WITH RESPECT TO A UNIT MAIN BODY

(75) Inventors: Takaya Akiyama, Osaka (JP); Shinichi Nakanishi, Osaka (JP); Takashi Tamura, Kobe (JP)

(73) Assignee: Kyocera Mita Corporation, Osaka (JP)

( * ) Notice: Subject to any disclaimer, the term of this patent is extended or adjusted under 35 U.S.C. 154(b) by 274 days.

(21) Appl. No.: 11/147,876

(22) Filed: Jun. 8, 2005

(65) Prior Publication Data

US 2006/0006298 A1 Jan. 12, 2006

(30) Foreign Application Priority Data

Jul. 12, 2004 (JP) ..... 2004-204630
Jul. 29, 2004 (JP) ..... 2004-221821
Jul. 29, 2004 (JP) ..... 2004-221822

(51) Int. Cl.
*G03G 15/00* (2006.01)

(52) U.S. Cl. ..... 399/81

(58) Field of Classification Search ..... 399/81, 399/107; 108/3
See application file for complete search history.

(56) References Cited

U.S. PATENT DOCUMENTS 5,083,290 A * 1/1992 Hosoi
5,268,817 A * 12/1993 Miyagawa et al.
5,457,453 A * 10/1995 Chiu et al.
5,715,431 A * 2/1998 Everett et al.
5,765,797 A * 6/1998 Greene et al.
5,818,360 A * 10/1998 Chu et al.
6,256,018 B1 * 7/2001 Zarek
6,934,502 B2 * 8/2005 Okuda ..... 399/81
7,062,197 B2 * 6/2006 Kunugi ..... 399/81
2002/0070922 A1 * 6/2002 Zarek
2003/0156382 A1 * 8/2003 Yukawa et al.
2004/0061683 A1 * 4/2004 Mochizuki et al.
2004/0140967 A1 * 7/2004 Kojo
2005/0226647 A1 * 10/2005 Lee ..... 399/81
2006/0170831 A1 * 8/2006 Muraki et al.
2006/0171734 A1 * 8/2006 Maeda ..... 399/81
2006/0280516 A1 * 12/2006 Combs et al. ..... 399/81

FOREIGN PATENT DOCUMENTS

JP 04-296920 10/1992
JP 06-019006 A 1/1994
JP 09-006185 A 1/1997
JP 10-039683 A 2/1998
JP 2001109543 A * 4/2001
JP 2003098905 A * 4/2003
JP 2003-283728 A 10/2003
JP 2004-038094 A 2/2004
JP 2004-085762 A 3/2004

* cited by examiner

*Primary Examiner*—Susan Lee
(74) *Attorney, Agent, or Firm*—Panitch Schwarze Belisario & Nadel LLP

(57) ABSTRACT

An image processing unit A has a unit main body 2 and a panel 1 that is supported movably with respect to the unit main body 2 and is equipped with a control component 5 and/or a display component 6, and has a panel support mechanism C that supports the panel 1 such that the control component 5 and/or the display component 6 can be changed from an upward orientation to a lateral orientation facing the side with respect to the unit main body 2, in conjunction with the movement of panel 1 toward the side.

12 Claims, 24 Drawing Sheets

(a)

(b)

(a)

(b)

PROCESSING UNIT HAVING A PANEL SUPPORTED MOVABLY WITH RESPECT TO A UNIT MAIN BODY

BACKGROUND OF THE INVENTION

1. Field of the Invention

The present invention relates to a processing unit having a panel equipped with a control component and/or a display component and supported movably with respect to a unit main body.

2. Description of the Related Art

The above-mentioned processing unit has a panel equipped with a control component and/or a display component, with said panel being supported movably with respect to the unit main body so that even people with limited eye height or who cannot get as close to the unit main body, such as a person in a wheelchair, can easily operate the control component and can easily make out the display of the display component. For example, with an image processing unit such as a copier, printer, or fax machine, there have been proposals in the past for units that allowed the attachment angle of the panel to be changed (see JP2004-85762 A, for example), and for units that allowed the panel to be moved toward the front of the unit main body (see JP2004-38094A, for example).

Meanwhile, the above-mentioned people with limited eye height or who cannot get as close to the unit main body may need to be able to move the panel to the side with respect to the unit main body, and to change the control component and/or the display component from an upward orientation to a lateral orientation facing to the side with respect to the unit main body. In this case, combining the above prior art requires that two operations be performed, in which the panel is moved to the side with respect to the unit main body, and the control component and/or the display component is changed from an upward orientation to a lateral orientation, the drawback to which is that the operation is complicated. Performing such operations is particularly difficult for a person in a wheelchair.

SUMMARY OF THE INVENTION

The present invention was conceived in light of the above situation, and it is an object thereof to provide a processing unit with which the panel can be moved toward the side with respect to the unit main body and the control component and/or display component provided to the panel can be changed from an upward orientation to a lateral orientation, all in a single operation.

The characteristic constitution of the processing unit according to the present invention for achieving the stated object is that said unit has a unit main body and a panel equipped with a control component and/or a display component, and also has a panel support mechanism for supporting the panel such that the control component and/or display component can change from an upward orientation to a lateral orientation facing to a side with respect to the unit main body in conjunction with the movement of the panel toward said side.

With this constitution, the panel can be moved toward the side with respect to the unit main body and the control component and/or display component provided to the panel can be changed from an upward orientation to a lateral orientation, all in a single operation.

The panel support mechanism can be constituted so as to support the panel such that the control component and/or display component can change continuously from the upward orientation to the lateral orientation in conjunction with the movement of the panel toward said side.

With this constitution, the unit can be operated while confirming the movement position of the panel toward the side, and the orientation of the control component and/or display component corresponding to this movement position. Furthermore, the orientations of the control component and/or the display component can be at an intermediate orientation midway in the movable range by selecting the intermediate position in the movable range as the movement position of the panel.

The panel support mechanism can be constituted so as to support the panel such that the panel moves downward in conjunction with the movement of the panel toward said side.

With this constitution, the panel can further be moved to a lower position in a single operation. Therefore, even a person with limited eye height, such as a person in a wheelchair or a person of short stature, can easily operate the control component, and can more easily confirm the display of the display component.

The panel support mechanism can be constituted so as to support the panel such that the panel is able to slide toward said side, the sliding movement of the panel toward said side is mechanically linked with the change in orientation of the control component and/or display component, and moving the panel toward said side changes the control component and/or display component from the upward orientation to the lateral orientation.

With this constitution, it is easier to achieve a simpler structure than when, for example, a panel movement apparatus is provided separately from an apparatus for changing the orientation of the control component and/or display component, and the movement apparatus and the orientation changing apparatus are operated synchronously so that the control component and/or display component is changed from an upward orientation to a lateral orientation as the panel moves toward the side.

The constitution can be such that for the mechanical link between the sliding movement and the change in orientation, the panel support mechanism supports the panel such that the panel can slide along an arc-shaped guide surface which extends progressively lower toward said side.

With this constitution, the sliding of the panel and the change in orientation of the control component and/or display component can be smoothly performed in a single operation.

The constitution can also be such that there is provided a gear linking mechanism that links the movement of the panel to the side with respect to the unit main body with the change in orientation of the control component and/or display component from an upward orientation to a lateral orientation.

With this constitution, the panel can be moved toward the side with respect to the unit main body, and the control component and/or display component provided to the panel can be changed from an upward orientation to a lateral orientation, all in a single operation comprising either the movement of the panel or the changing of the orientation of the control component and/or display component. Also, the amount of panel movement or the angle by which the orientation of the control component and/or display component is changed can be simply set as desired and according to the function, shape, and other such specifications of the processing unit by changing the number of teeth on a gear, the pitch of the teeth, or the like.

The constitution can also be such that there is provided a support member that is vertically pivotably attached to the unit main body and movably supports the panel, wherein the gear linking mechanism is constituted such that the support member pivots downward as the panel moves toward said side.

With this constitution, vertically pivotably attaching the support member to the unit main body allows the support member to be pivoted downward along with the panel as the panel is moved toward the side with respect to the unit main body, and allows the control component and/or display component to be changed from an upward orientation to a lateral orientation. Therefore, the panel can be moved toward the side with respect to the unit main body, and the control component and/or display component provided to the panel can be changed from an upward orientation to a lateral orientation, all in a single operation.

The constitution can also be such that there is provided a support component that is fixed to the unit main body and that movably and vertically pivotably supports the panel, wherein the gear linking mechanism is constituted such that the panel pivots downward as the panel moves toward said side.

With this constitution, the panel can be pivoted downward, and the control component and/or display component can be changed from an upward orientation to a lateral orientation in a single operation in which the panel is moved toward the side with respect to the unit main body. Also, since the support component that supports the panel is fixed to the unit main body, an advantage is that there is less restriction in terms of disposal on the unit main body side.

The constitution can also be such that there is provided a control panel equipped with a control component and a display panel equipped with a display component, and a panel support mechanism supports the control panel and the display panel individually and movably toward said side, and individually supports the control panel and the display panel such that they can be separately changed from an upward orientation to a lateral orientation facing toward said side in conjunction with the movement toward said side.

With this constitution, the panel can be changed from an upward orientation to a lateral orientation in a single operation in which the control panel and the display panel are each moved toward the side with respect to the unit main body as necessary. Herein each panel can be individually changed in orientation to different positions.

The constitution can also be such that there is provided a control panel equipped with a control component and a display panel equipped with a display component, and a panel support mechanism supports the control panel movably toward the side with respect to the unit main body, supports the display panel pivotably toward said side, and individually supports the control panel and the display panel such that they can be separately changed from an upward orientation to a lateral orientation facing toward said side in conjunction with the movement of the control panel toward said side, or with the pivoting of the display panel toward said side.

With this constitution, the control panel and the display panel can each be individually changed from an upward orientation to a lateral orientation either by a single operation in which the control panel is moved toward the side, or by a single operation in which the display panel is pivoted toward the side.

The panel support mechanism can be constituted such that the display panel can be changed to a lateral orientation that faces more toward said side than the control panel.

With this constitution, the control panel and the display panel can each be suitably oriented such that a person with limited eye height, such as a person in a wheelchair or a person of short stature, can easily confirm the display content from the side with respect to the unit main body while changing the orientation of the control panel to a lateral orientation that makes it easier to reach the control panel with the hands from the side with respect to the unit main body.

The constitution can also be such that there is provided a control panel equipped with a control component and a display panel equipped with a display component, and a panel support mechanism individually supports the control panel and the display panel movably toward the side with respect to the unit main body, and individually supports the control panel and the display panel such that they can be separately changed from an upward orientation to a lateral orientation facing toward said side in conjunction with the movement of either the control panel or the display panel toward said side.

With this constitution, the control panel and the display panel can be individually changed from an upward orientation to a lateral orientation facing toward the side in a single operation in which either the control panel or the display panel is moved toward the side with respect to the unit main body.

Other features and advantages of the present invention should become apparent from the following description of embodiments through reference to the drawings.

DESCRIPTION OF THE PREFERRED EMBODIMENTS

Embodiments of the present invention will now be described through reference to the drawings.

First Embodiment

Figure 1:
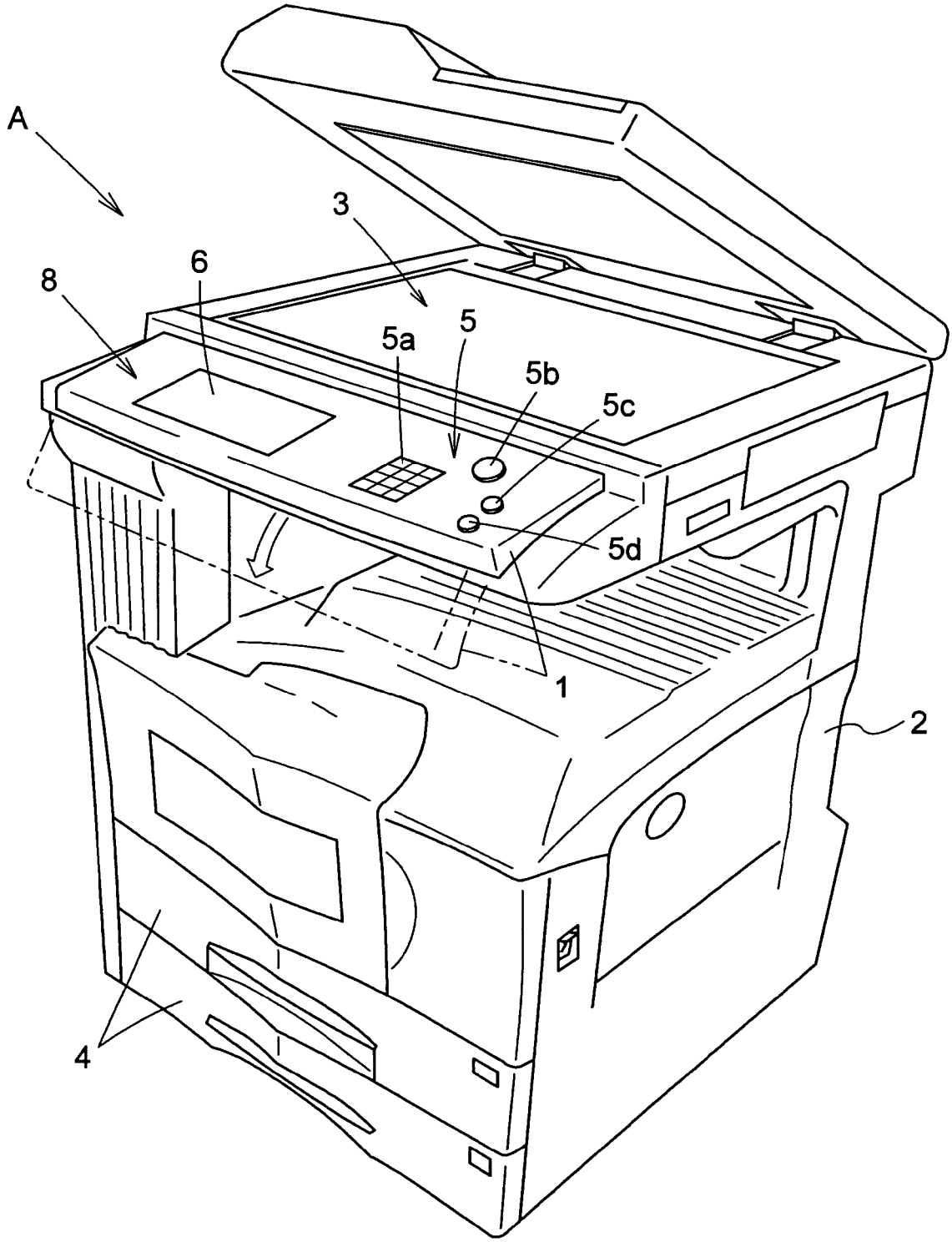
FIG. 1 is a perspective view of the processing unit according to a first embodiment.

First, a first embodiment of the processing unit according to the present invention will be described. FIG. 1 is a perspective view of the processing unit according to the first embodiment of the present invention. In this embodiment, the present invention is applied to a copier, printer, fax machine, or other such image processing unit A as an example of a processing unit. This image processing unit A comprises a panel 1 for control input or display of the processing status in the course of executing image processing, with this panel 1 being movably supported with respect to a unit main body 2.

The unit main body 2 houses an image processor for performing image processing, an imaging component for forming images on a sheet material, and so forth. The panel 1 and a scanner 3 having a scanning function for reading documents are provided on the top side of the unit main body 2. A paper feed cassette 4 or the like for holding sheets for printing output is provided at the bottom part of the unit main body 2.

A control component 5 for executing image processing, and a display component 6 consisting of a liquid crystal display device or the like for displaying the processing status and other such information are provided on the top side of the panel 1. The control component 5 is provided with a liquid crystal touch panel 5*a*, a start key 5*b* for inputting a command to start copying, a clear key 5*c* for deleting the inputted content, a stop key 5*d* for inputting a command to halt the processing work, and so forth.

Figure 2:
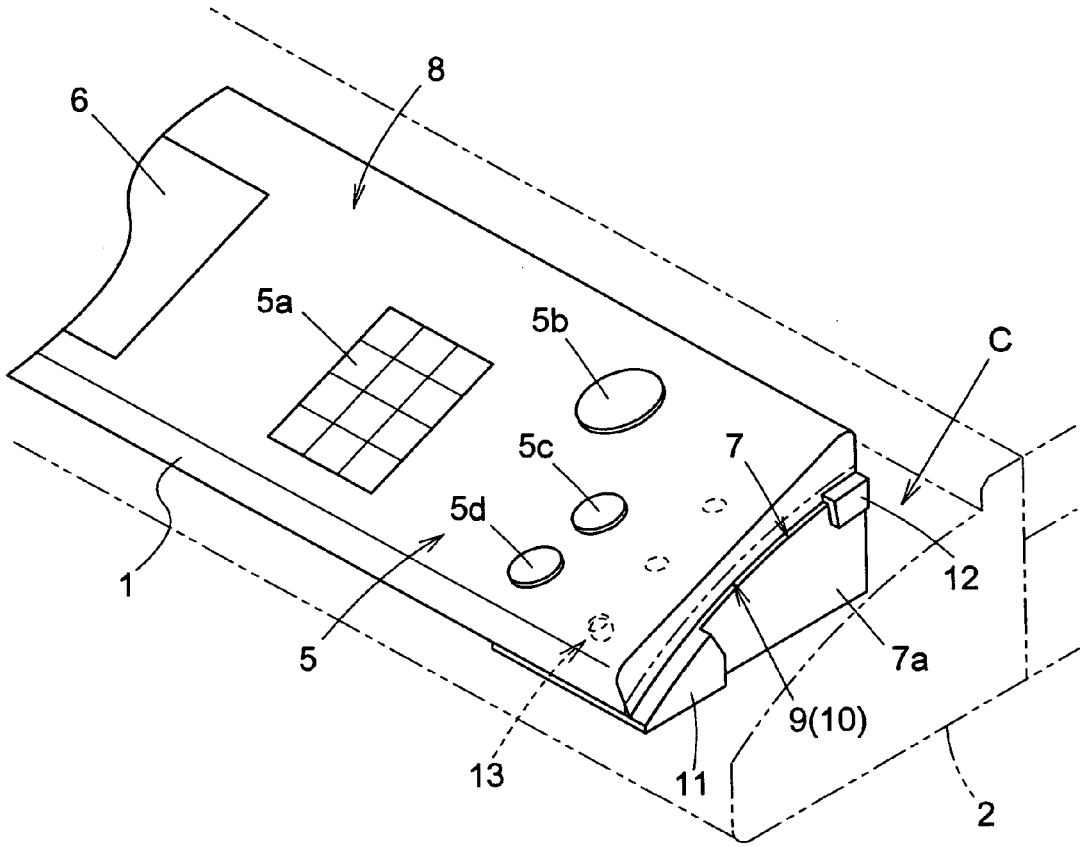
FIG. 2 is a perspective view of the main components of the processing unit according to the first embodiment.
Figure 3:
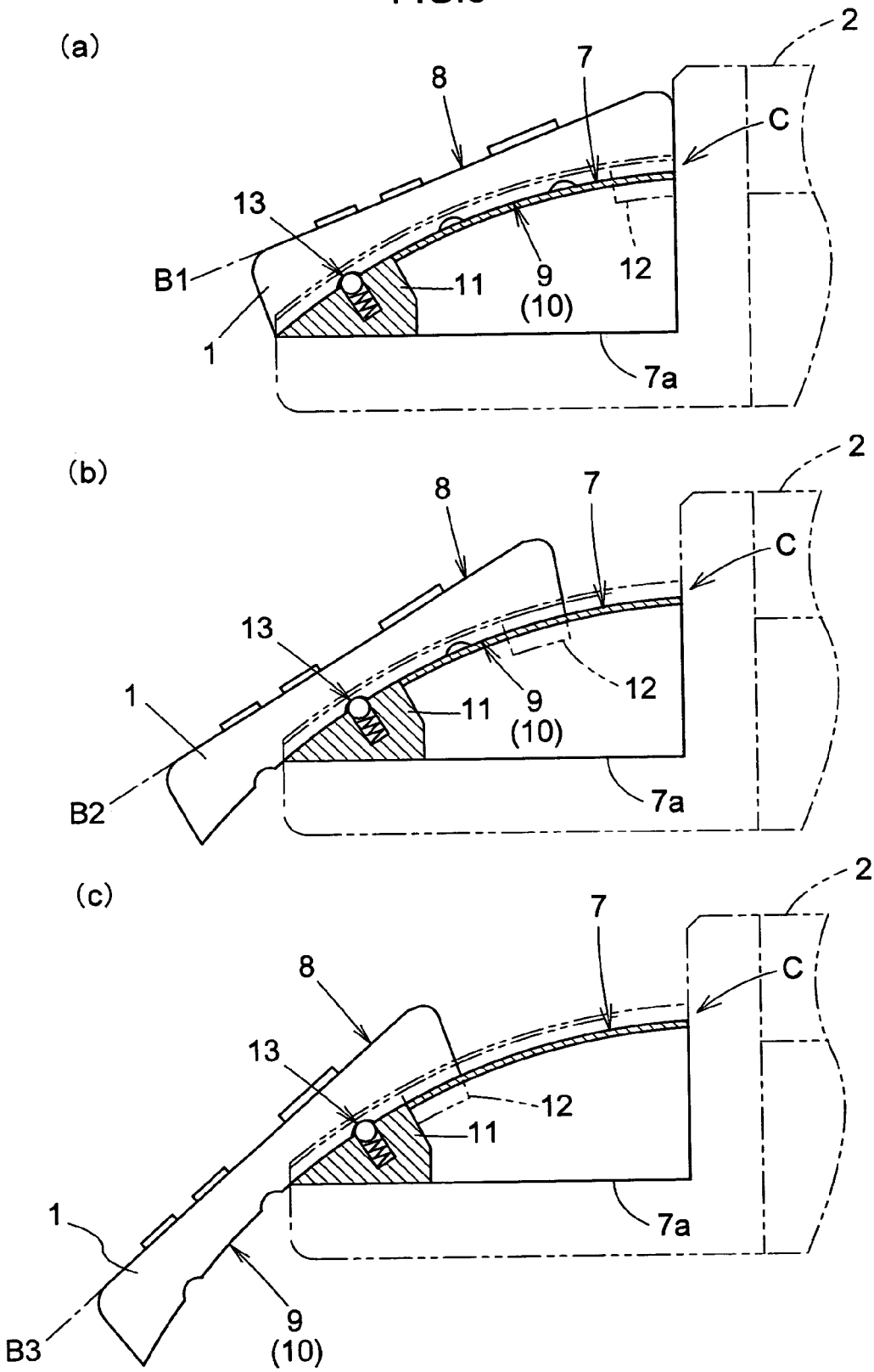
FIGS. 3*a* to 3*c* are perspective views of the main components of the processing unit according to the first embodiment.

As shown in FIGS. 2 and 3, the panel 1 is supported by a panel support mechanism C so as to be movable with respect to the unit main body 2. The panel support mechanism C mechanically links the sliding movement of the panel 1 toward the front side with respect to the unit main body 2 (an example of the side with respect to the unit main body) with the change in orientation of the control component 5 and the display component 6. As a result, the control component 5 and the display component 6 are changed from an upward orientation to a lateral orientation facing toward the front side by grasping the front edge of the panel 1 with the hands and pulling the entire panel toward the front side with respect to the unit main body 2. The entire panel 1 simultaneously moves downward at this time. This panel support mechanism C supports the panel 1 with respect to the unit main body 2 such that the panel 1 is reversibly movable.

The panel support mechanism C has a guide surface 7 that is arc-shaped when viewed from the side and becomes lower in height (extends progressively lower) toward the front side, provided to the top part of the front side of the unit main body 2. The panel support mechanism C is constituted so as to support the entire panel 1 such that the panel 1 can slide back and forth, toward and away from the front side with respect to the unit main body 2 along the guide surface 7. The panel 1 is shaped so as to have a substantially flat upper surface 8 on which the control component 5 and the display component 6 are provided, and a lower surface 10 on which is formed a guided surface 9 with an arc shape having substantially the same curvature as the guide surface 7 when viewed from the side. The guided surface 9 of the panel 1 is designed to be aligned with the guide surface 7.

A stopper 11 protrudes from the left and right sides of a guide member 7*a* on which the guide surface 7 is formed. A convey component 12 is provided on the left and right sides of the panel 1. As shown in FIG. 3*c*, when the stopper 11 hits the convex component 12, the panel 1 is held in its maximum tilt position B3 at which the control component 5 and the display component 6 are tilted the farthest toward the front side. An elastic latching mechanism 13, such as a ball detent, is provided removably with the movement of the panel 1 to the left and right sides of the sliding components between the guide surface 7 and the guided surface 9. As a result, the panel 1 also can be held at its normal position B1 at which the control component 5 and the display component 6 face upward the most, as shown in FIG. 3*a*, and at an intermediate position B2 midway between the normal position B1 and the maximum tilt position B3, as shown in FIG. 3*b*.

Therefore, in the normal position B1, as shown in FIG. 3*a*, the panel 1 can be held at its highest position, with the control component 5 and the display component 6 in their most upward-facing orientation. In the intermediate position B2, as shown in FIG. 3*b*, the panel 1 can be held in its intermediate position within the range of fore and aft movement and the range of up and down movement, with the control component 5 and the display component 6 tilted somewhat more toward the front side than when in the normal position B1. In the maximum tilt position B3, the panel 1 can be held in its lowest position, with the control component 5 and the display component 6 tilted the most toward the front side.

Figure 4:
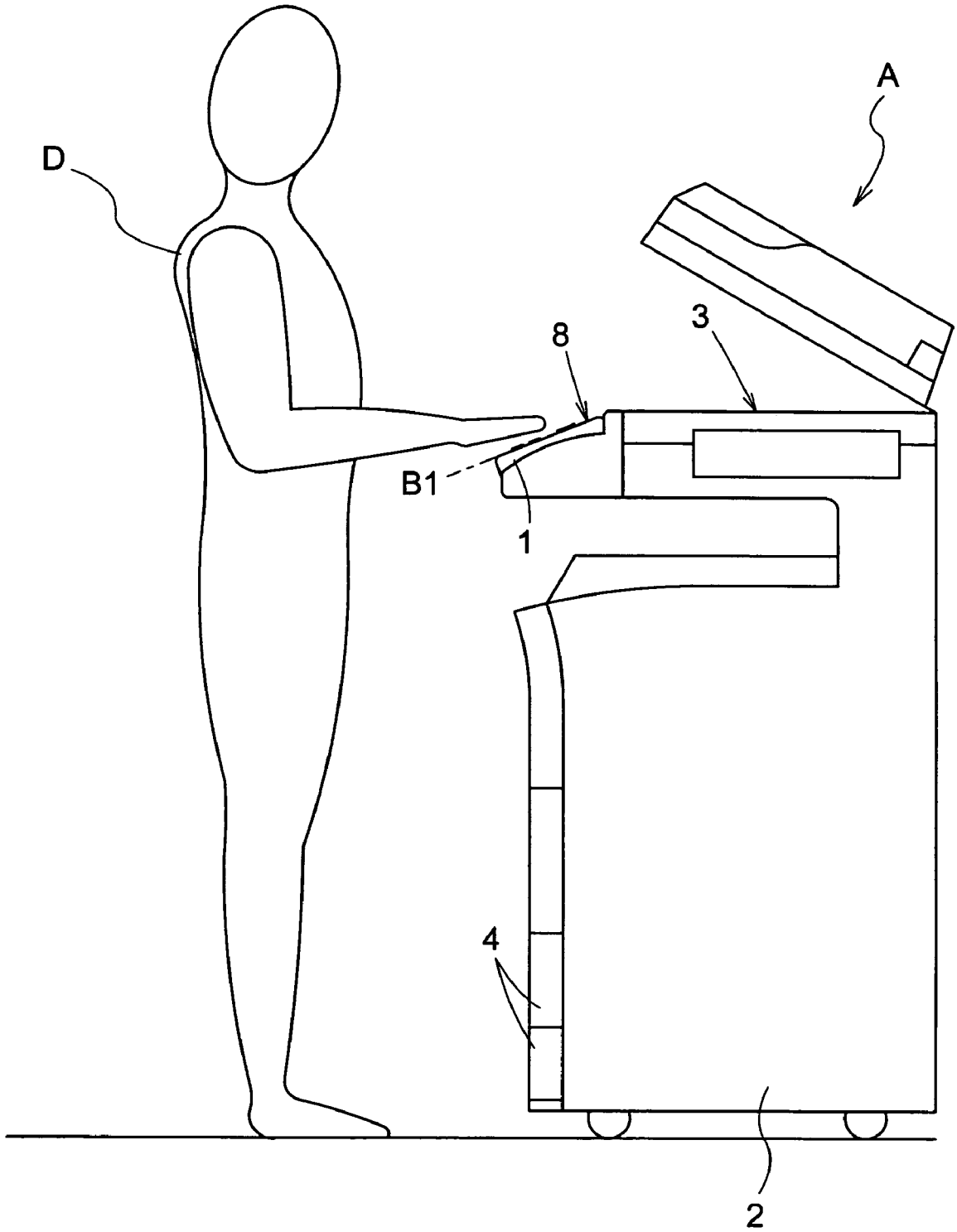
FIG. 4 is a diagram (1) of how the processing unit according to the first embodiment is used.
Figure 5:
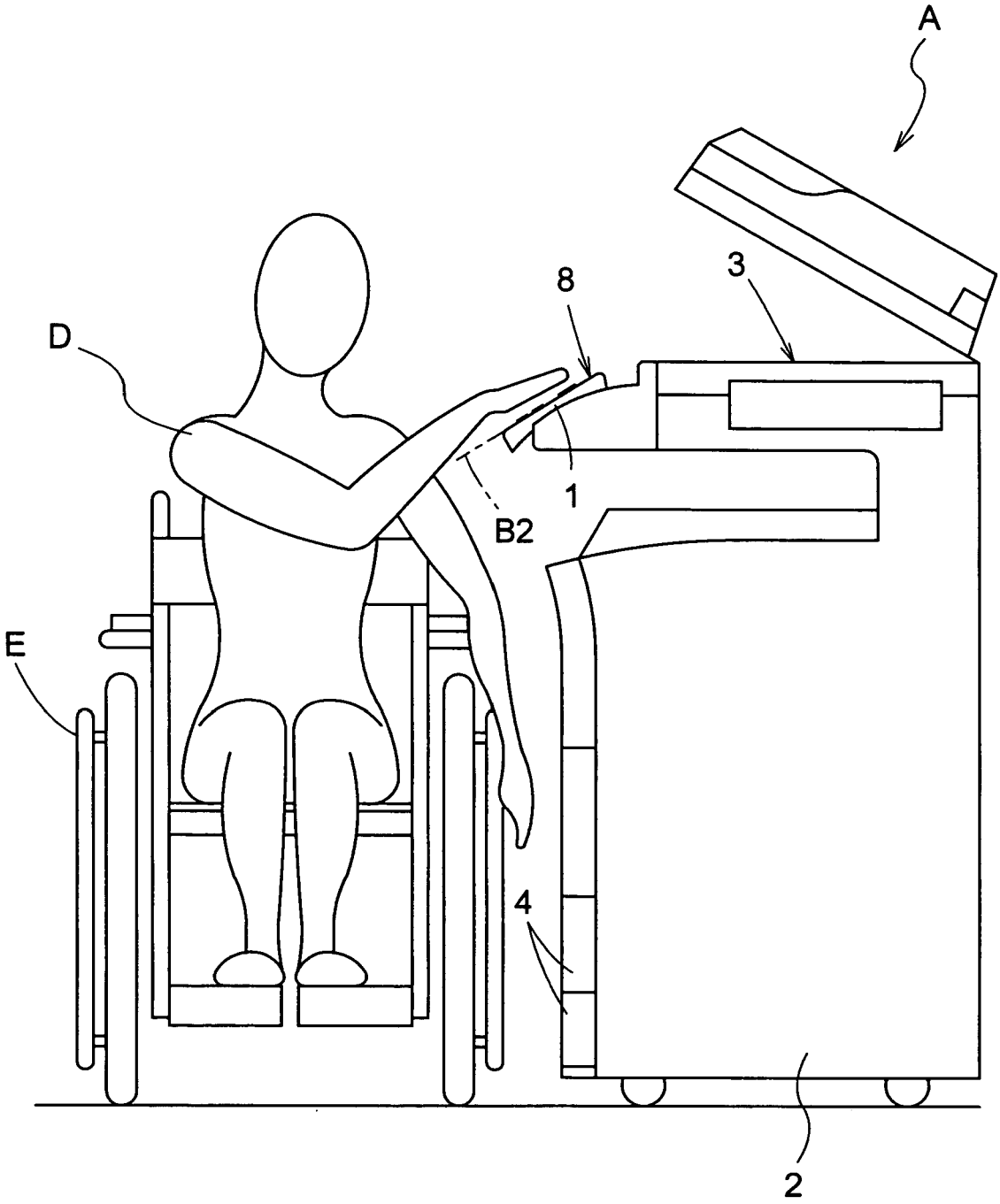
FIG. 5 is a diagram (2) of how the processing unit according to the first embodiment is used.
Figure 6:
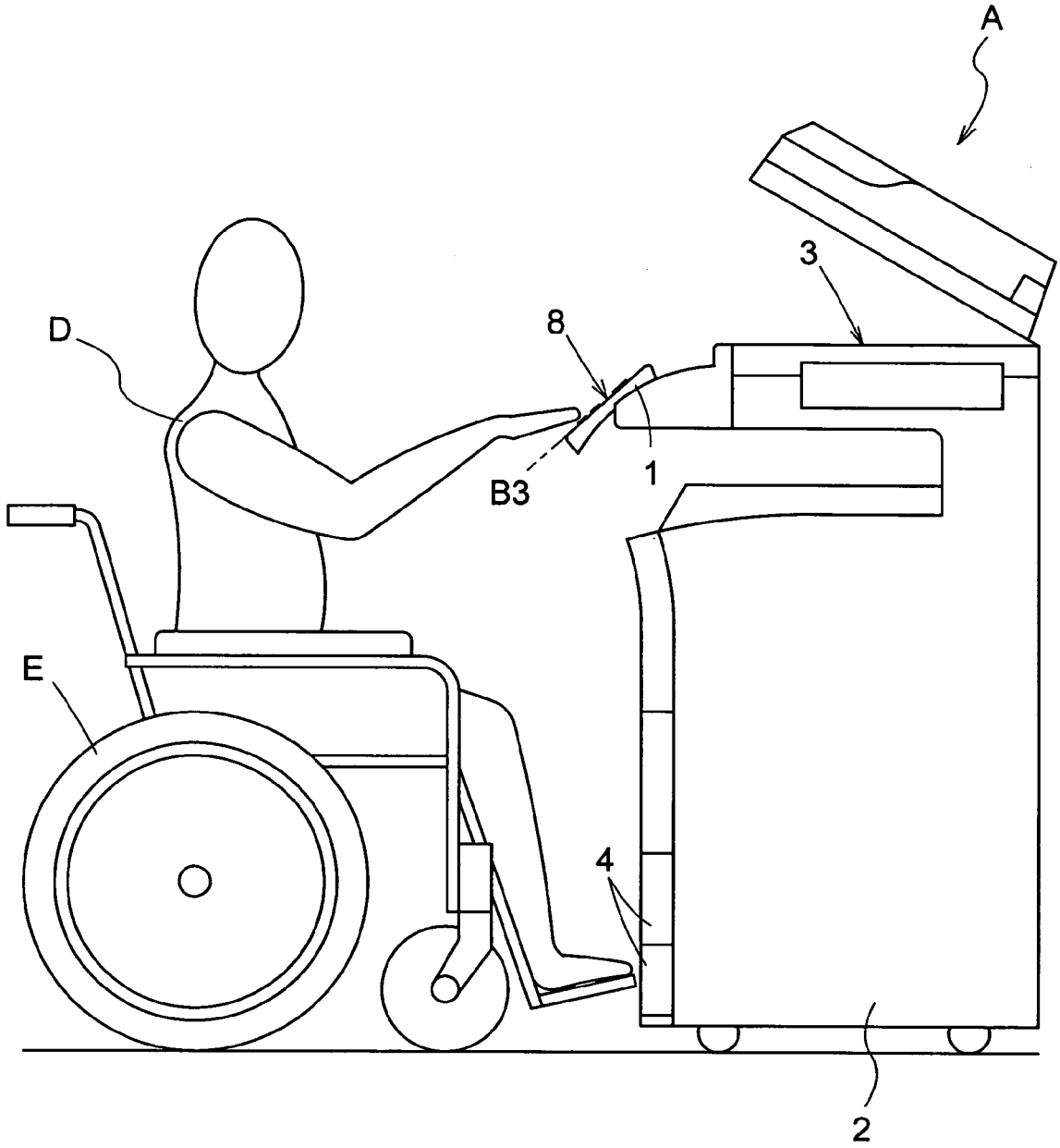
FIG. 6 is a diagram (3) of how the processing unit according to the first embodiment is used.

When the image processing unit A is constituted as above, if a user D is a person of average eye height, such as a healthy person not in a wheelchair E, as shown in FIG. 4, the panel 1 can be used while held at the normal position B1, at which the control component 5 and the display component 6 are easier to see from a high position. If the user D is a person of lower eye height, such as a handicapped person in the wheelchair E, as shown in FIG. 5, when the wheelchair E is moved up sideways next to the front of the unit main body 2, the panel 1 is used from a relatively close position. In view of this, the panel 1 can be used while held at the intermediate position B2, at which the control component 5 and the display component 6 are easier to see when viewed from diagonally above at a lower position. When the wheelchair E is moved head-on up to the front of the unit main body 2, as shown in FIG. 6, the panel 1 is used from a relatively distant position. In view of this, the panel 1 can be used while held at the maximum tilt position B3, at which the control component 5 and the display component 6 are easier to see when viewed from straight ahead at a low position.

Second Embodiment

Figure 7:
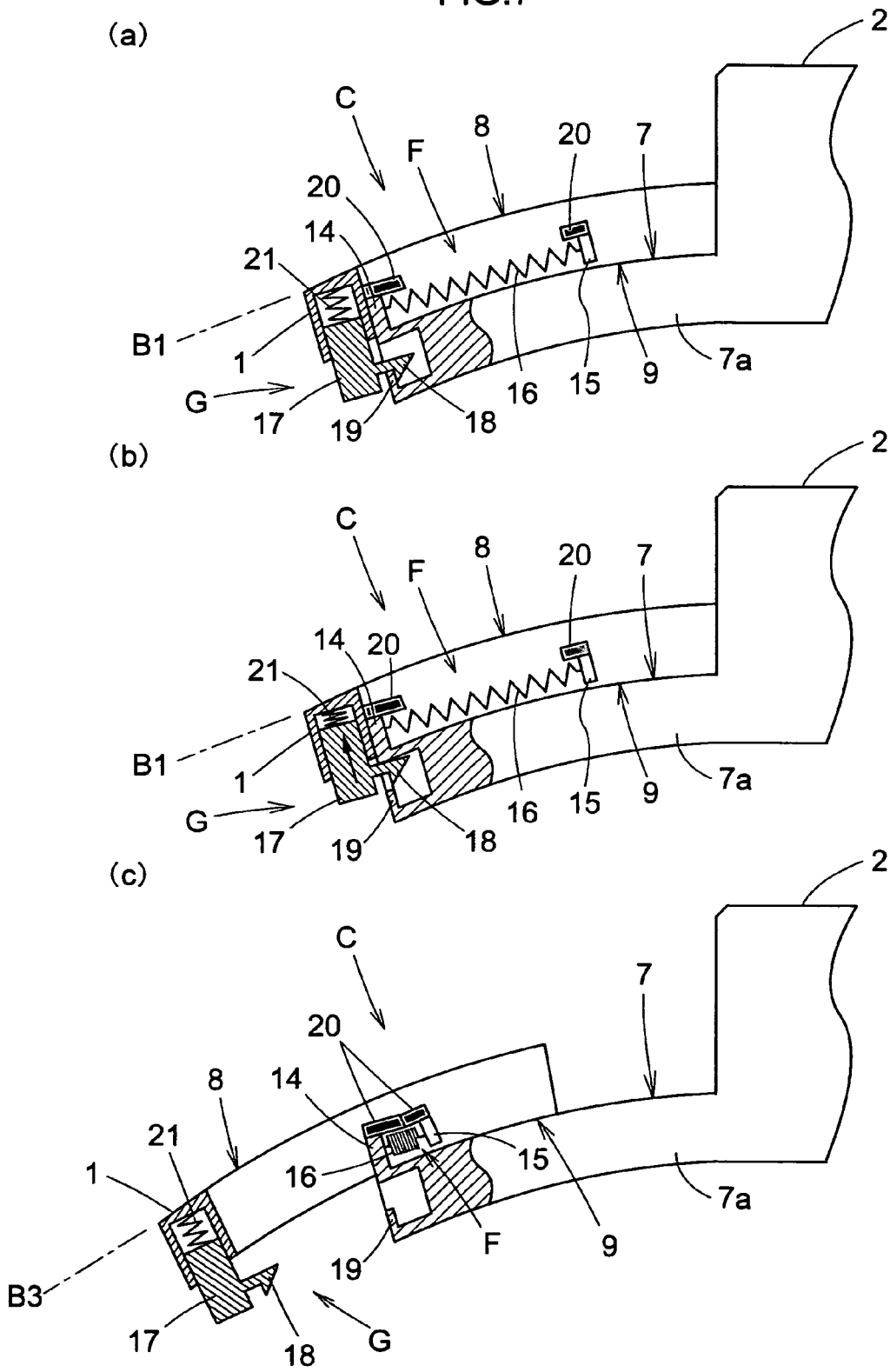
FIGS. 7*a* to 7*c* are cross sectional views of the main components of the processing unit according to a second embodiment.

A second embodiment of the processing unit according to the present invention will now be described. FIGS. 7*a* to 7*c* are diagrams of the second embodiment of the processing unit according to the present invention. As shown in FIGS. 7*a* to 7*c*, the panel support mechanism C has on the left and right sides of the panel 1 a biasing mechanism F for biasing the panel 1 so as to move to the maximum tilt position B3, at which the panel 1 protrudes the farthest forward toward the front side with respect to the unit main body 2 (an example of the side with respect to the unit main body). The panel support mechanism C also has in the approximate center in the left-right direction of the panel 1 a locking mechanism G capable of fixing the panel 1 in the normal position B1 in which the panel 1 is retracted the farthest from the front side with respect to the unit main body 2. As a result, the panel support mechanism C supports the panel 1 such that the panel 1 is capable of moving to two positions: the normal position B1 and the maximum tilt position B3.

The biasing mechanism F comprises a guide-side protrusion 14 provided to the front end of the guide member 7*a* so as to protrude upward above the guide surface 7, and a panel-side protrusion 15 provided to the back side of the panel 1 so as to protrude toward the guide surface 7, with the guide-side protrusion 14 and the panel-side protrusion 15 linked by a coil spring 16 (an example of an elastic member). As a result, the panel 1 that has moved to the maximum tilt position B3 shown in FIG. 7*c* stretches the coil spring 16 while moving to the normal position B1 shown in FIGS. 7*a* and 7*b*. The biasing force of the coil spring 16 allows the panel 1 to return from the normal position B1 to the maximum tilt position B3.

The locking mechanism G has a control member 17 that is supported by the panel 1 in a state of being able to move up and down, and is biased downward by a spring 21. The locking mechanism G also comprises a latch hook 18 of the control member 17 that is pushed in when the panel 1 has been moved to the normal position B1, and a latching component 19 capable of latching so as to obstruct the movement of the panel 1 to the maximum tilt position B3, and provided at the front end of the guide member 7*a*.

When the panel 1 is moved by hand from the maximum tilt position B3 toward the normal position B1, the coil spring 16 is elastically stretched and the latch hook 18 of the control member 17 is latched to the latching component 19, and as shown in FIG. 7*a*, the panel 1 is held at the normal position B1. When the panel 1 is to be moved from the normal position B1 to the maximum tilt position B3, as shown in FIG. 7*b*, the control member 17 is pushed up with a finger, unlatching the latch hook 18 and the latching component 19, and as shown in FIG. 7*c*, the panel 1 moves to the maximum tilt position B3 under the biasing force produced by the contraction of the coil spring 16.

Magnets 20 that attract each other, such as a magnetic catch, are provided to the panel-side protrusion 15 and the guide-side protrusion 14 so as to fix the panel 1 that has been moved to the maximum tilt position B3 to the unit main body 2 side.

Instead of latching the latch hook 18 and the latching component 19 as above, the locking mechanism G may be constituted such that magnets 20 that attract each other, such as a magnetic catch, are provided to the panel 1 side and the unit main body 2 side, allowing the panel 1 to be fixed in the normal position B1 by the attraction of these magnets.

The rest of the constitution is the same as in the first embodiment.

Third Embodiment

Figure 8:
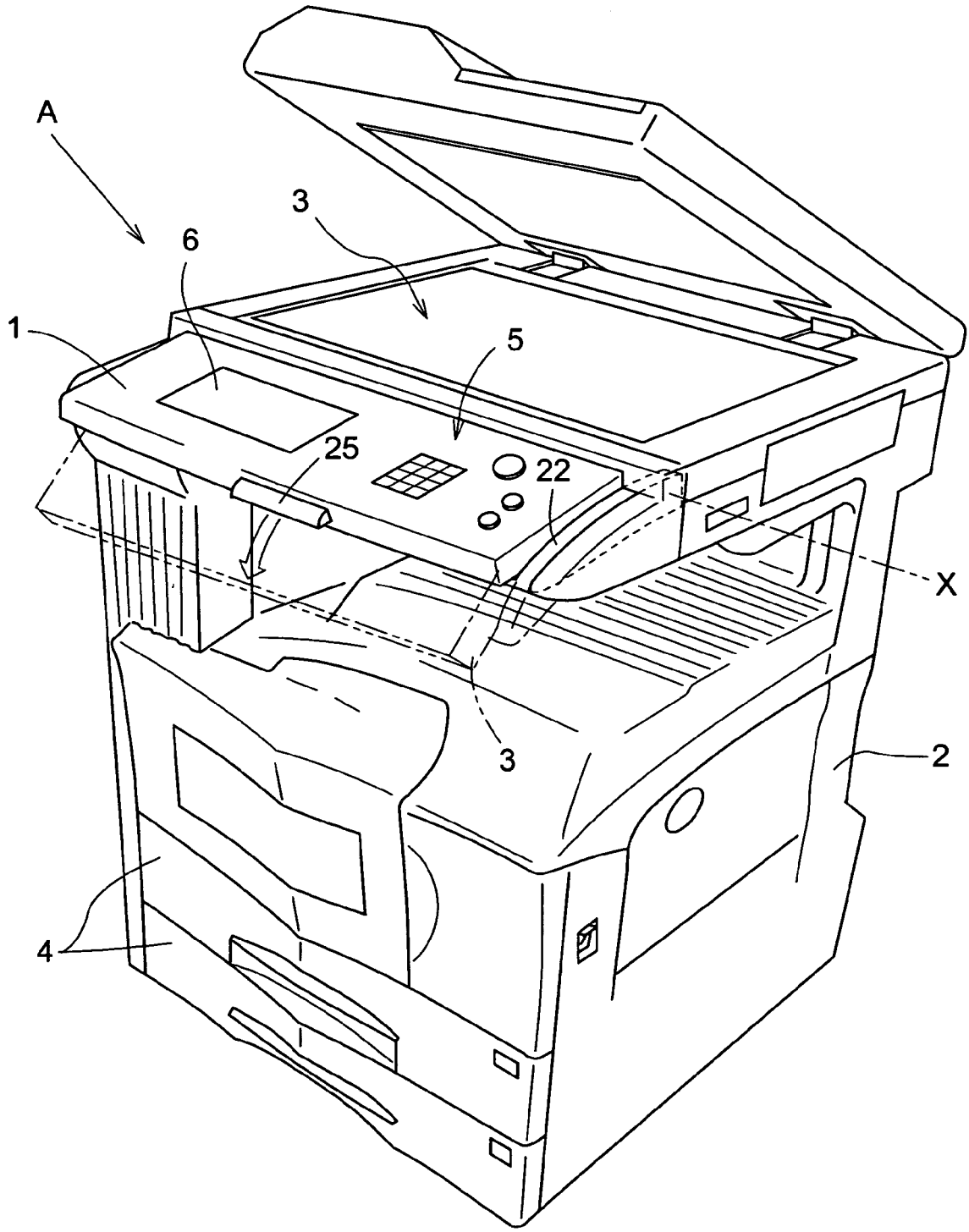
FIG. 8 is a perspective view of the processing unit according to a third embodiment.

A third embodiment of the processing unit according to the present invention will now be described. FIG. 8 is a perspective view of the processing unit according to the third embodiment of the present invention. In this embodiment, the present invention is applied to a copier, printer, fax machine, or other such image processing unit A as an example of a processing unit. This image processing unit A comprises a panel 1 equipped with a control component 5 for inputting commands in the execution of image processing, and a display component 6 consisting of a liquid crystal display device or the like for displaying the processing status and other such information, and this panel 1 is supported movably with respect to a unit main body 2.

The control component 5 is provided with a liquid crystal touch panel or setting keys for switching the image processing mode and so forth, input keys for inputting commands such as starting or stopping copying, canceling, etc., and the like.

The unit main body 2 houses an image processor for performing image processing, an imaging component for forming images on a sheet material, and so forth. The panel 1 and a scanner 3 having a scanning function for reading documents are provided on the top side of the unit main body 2. A paper feed cassette 4 or the like for holding sheets for printing output is provided at the bottom part of the unit main body 2.

Figure 9:
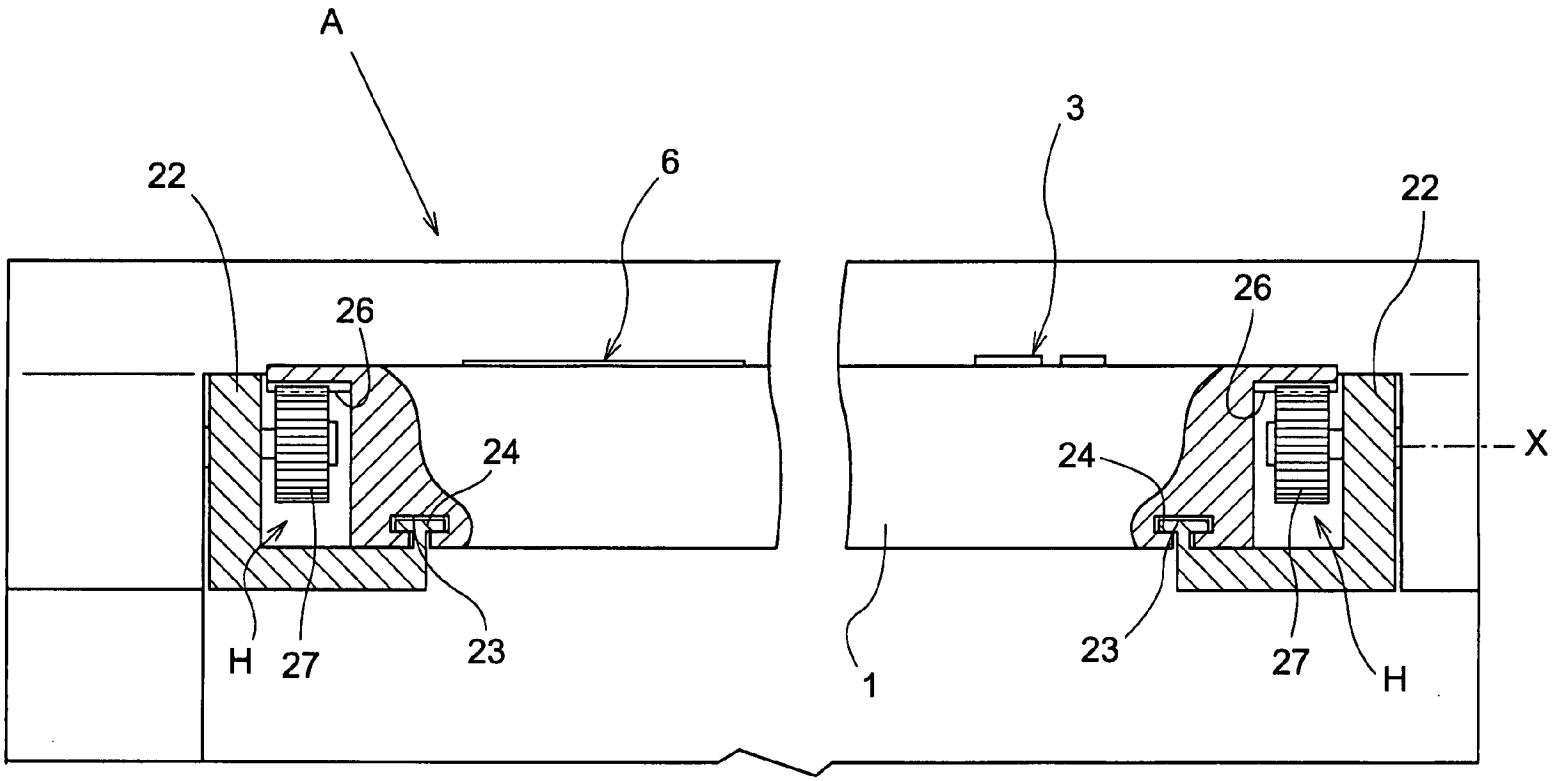
FIG. 9 is a partial cross sectional front view of the main components of the processing unit according to the third embodiment.
Figure 10:
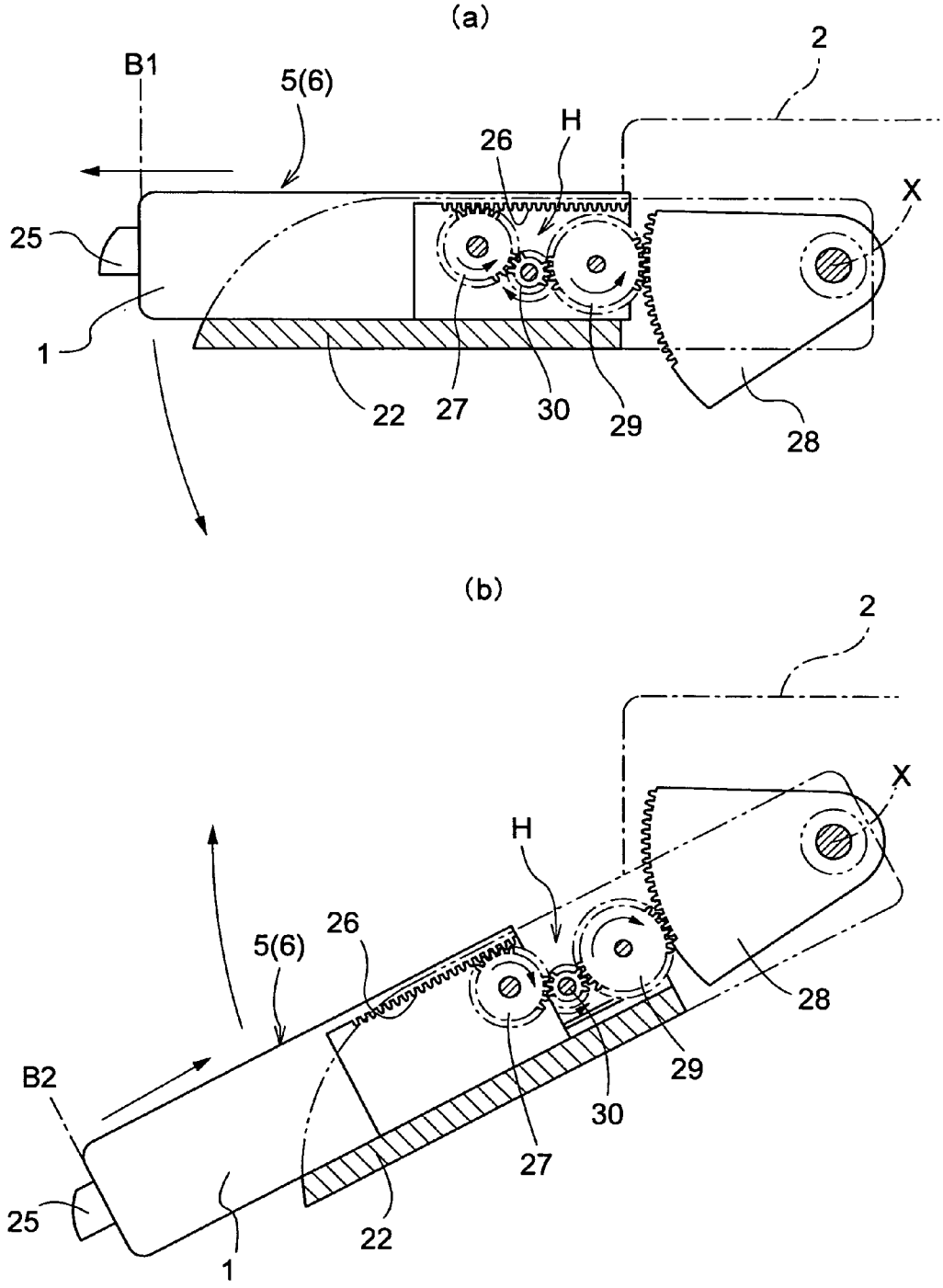
FIGS. 10*a* and 10*b* are side views of the main components of the processing unit according to the third embodiment.

The panel 1 is supported by the panel support mechanism C so as to be movable with respect to the unit main body 2. Specifically, as shown in FIGS. 9 and 10, the left and right sides of the panel 1 are supported by a pair of left and right support members 22 attached vertically pivotably around a lateral axis X to the left and right lateral sides of the unit main body 2. Upward-facing protrusions 24 provided in the lengthwise direction of the support members 22 fit into downward grooves 23 provided along the left and right lower surfaces of the panel 1. The support members 22 support the panel 1 such that the panel 1 can moved back and forth toward the front side with respect to the unit main body 2 (an example of the side with respect to the unit main body) when a knob 25 provided to the front edge of the panel 1 is grasped and pushed or pulled.

As shown in FIGS. 10*a* and 10*b*, a gear linking mechanism H is provided that links the movement of the panel 1 toward the front side with respect to the unit main body 2, with the changing of the control component 5 and the display component 6 provided to the panel 1 from an upward orientation to a lateral orientation facing toward the front side with respect to the unit main body 2, between the panel 1 and the support members 22. In this embodiment, the panel support mechanism C is constituted by this gear linking mechanism H and the support members 22.

The gear linking mechanism H has rack gears 26 provided facing downward to the left and right sides of the panel 1, and pinion gears 27 that mesh with the rack gears 26 and are rotatably supported by the support members 22. Also, the gear linking mechanism H has stationary toothed components 28 disposed at the lateral sides of the unit main body 2 in an arc shape that is concentric with the lateral axis X. First gears 29 that mesh with these stationary toothed components 28, and second gears 30 that mesh with the first gears 29 and the pinion gears 27 are rotatably supported by the support members 22.

Therefore, as shown in FIG. 10*a*, when the panel 1 is moved from the normal position B1, in which it is retracted the farthest to the unit main body 2 side, toward the front side, this movement is accompanied by rotation of the pinion gears 27, and the first gears 29 rotate along with the support members 22 around the lateral axis X while meshed with the stationary toothed components 28. As shown in FIG. 10*b*, the support members 22 pivot downward along with the panel 1, changing the control component 5 and the display component 6 from an upward orientation to a lateral orientation.

Also, as shown in FIG. 10*b*, when the panel 1 moves back toward the unit main body 2 side from the extended position B2 where it protrudes the farthest toward the front side with respect to the unit main body 2, this movement is accompanied by the reverse rotation of the pinion gears 27, and the first gears 29 mesh with the stationary toothed components 28 and rotate in reverse along with the support members 22 around the lateral axis X. As shown in FIG. 10*a*, the support members 22 pivot back upward along with the panel 1, and the control component 5 and the display component 6 are changed from a lateral orientation to an upward orientation.

It is also possible operate the panel 1 by grasping the left and right support members 22 supporting the panel 1, rather than grasping the knob 25. Specifically, the left and right support members 22 supporting the panel 1 at the normal position B1 shown in FIG. 10*a* are grasped and forcibly pivoted downward, changing the control component 5 and the display component 6 from an upward orientation to a lateral orientation. Along with this operation, it is also possible to move the panel 1 to the protruding position B2, as shown in FIG. 10*b*, by rotating the first gears 29 meshed with the stationary toothed components 28, and rotating the pinion gears 27. Also, the left and right support members 22 supporting the panel 1 in the protruding position B2 shown in FIG. 10*b* are grasped and forcibly pivoted upward to change the control component 5 and the display component 6 from a lateral orientation to an upward orientation. Along with this operation, it is also possible to move the panel 1 back to the normal position B1, as shown in FIG. 10*a*, by rotating in reverse the first gears 29 meshed with the stationary toothed components 28, and rotating in reverse the pinion gears 27.

Fourth Embodiment

Figure 11:
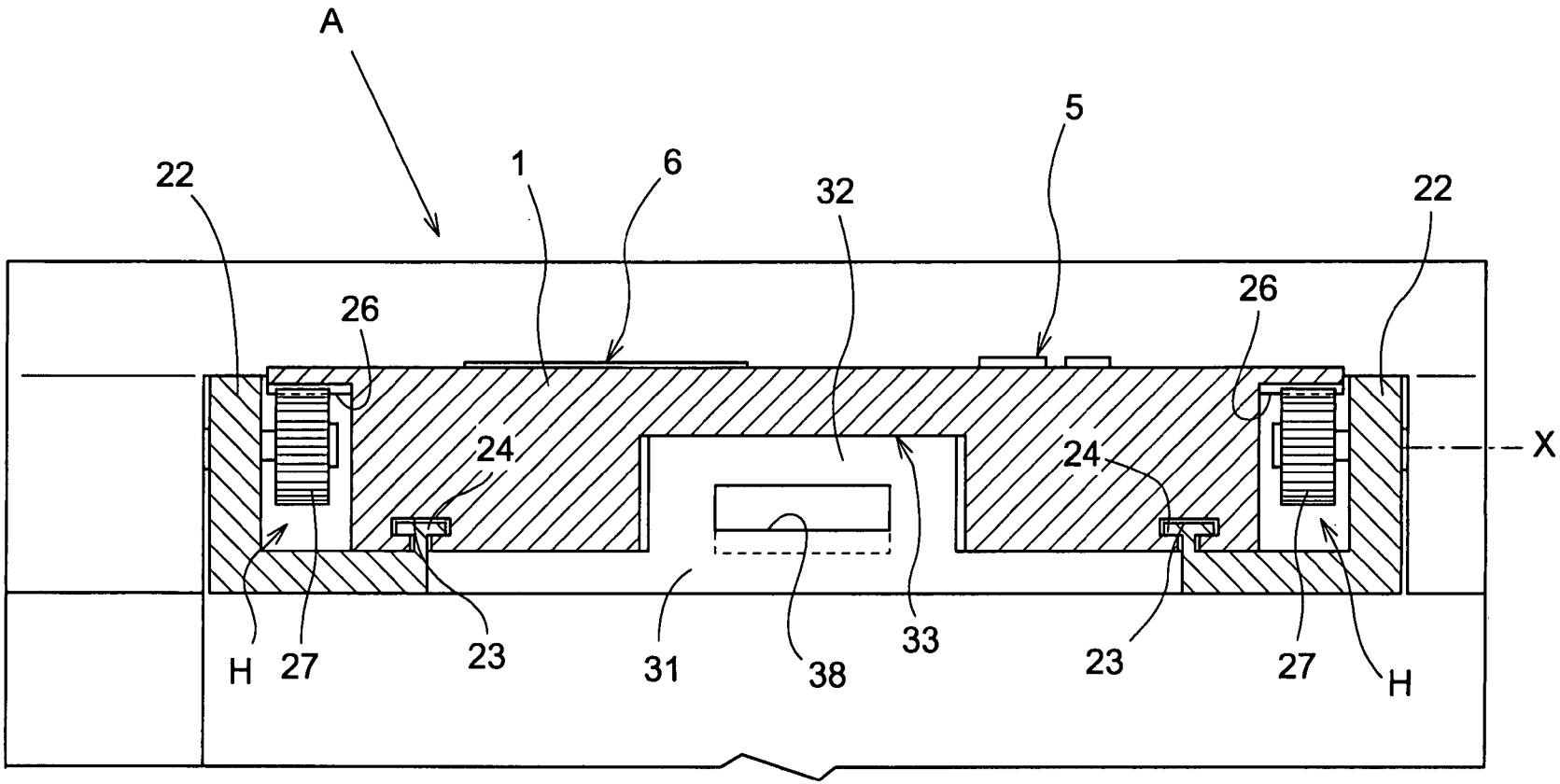
FIG. 11 is a partial cross sectional front view of the main components of the processing unit according to a fourth embodiment.
Figure 12:
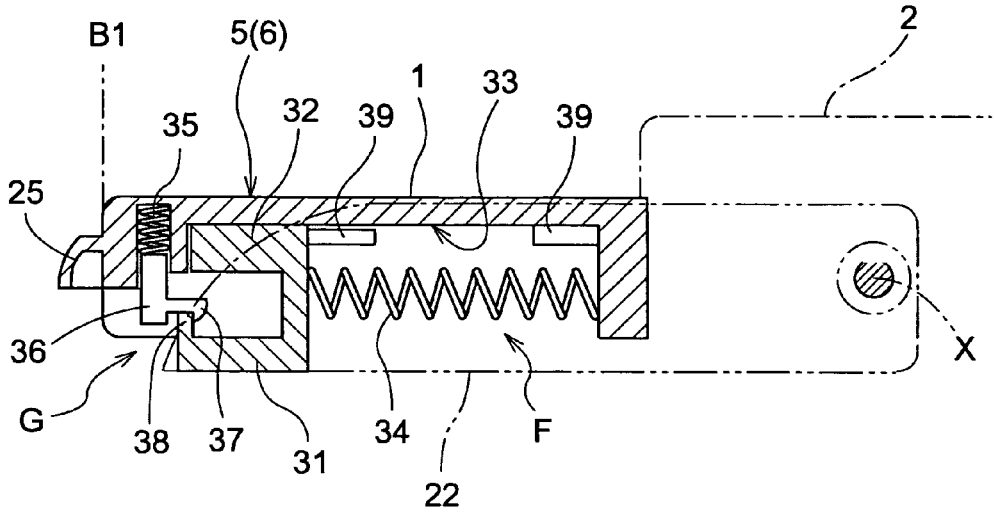
FIGS. 12*a* and 12*b* are partial cross sectional front views of the main components of the processing unit according to the fourth embodiment.
Figure 12:
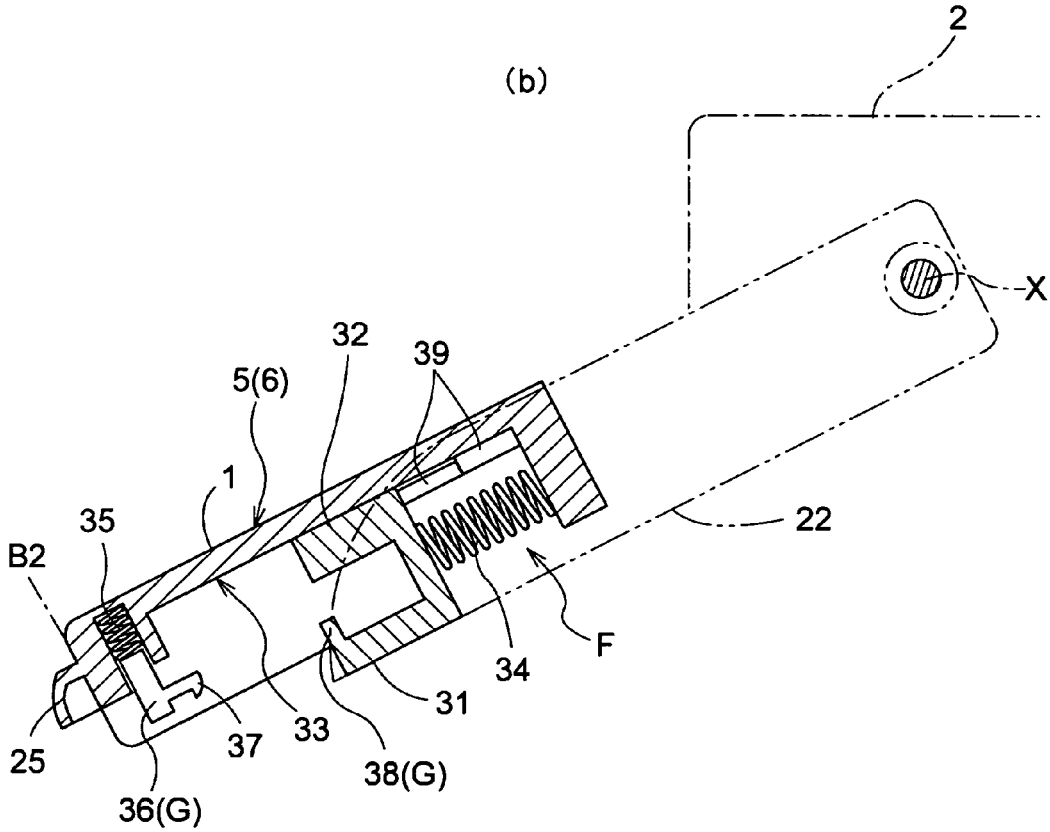

A fourth embodiment of the processing unit according to the present invention will now be described. FIGS. 11 and 12 are diagrams of the fourth embodiment of the processing unit according to the present invention. As shown in these drawings, the panel support mechanism C of the processing unit according to this embodiment has a biasing mechanism F for biasing the panel 1 so as to move to a extended position B2 where it protrudes the farthest toward the front side with respect to the unit main body 2, and a locking mechanism G capable of fixing the panel 1 in the normal position B1 in which the panel 1 is retracted the farthest from the front side with respect to the unit main body 2.

Here, as shown in FIG. 11, the left and right support members 22 are linked by a linking member 31 and integrally pivotably supported. The biasing mechanism F comprises a convex component 32 formed in an intermediate position in the lengthwise direction of the linking member 31 and fitted into a concave component 33 formed on the lower surface of the panel 1, with the convex component 32 and the inner part of the concave component 33 linked by a coil spring 34 (an example of an elastic member). As a result, the panel 1 that has moved to the extended position B2 shown in FIG. 12*b* stretches the coil spring 34 while moving to the normal position B1 shown in FIG. 12*a*. The biasing force of the coil spring 34 allows the panel 1 to return from the normal position B1 to the extended position B2.

The locking mechanism G has a control member 36 that is supported by the panel 1 in a state of being able to move up and down, and is biased downward by a spring 35. The locking mechanism G also comprises a latch hook 37 of the control member 36 that is pushed in when the panel 1 has been moved to the normal position B1, and a latching component 38 capable of latching so as to obstruct the movement of the panel 1 to the extended position B2, and provided at the front end of the linking member 31.

When the panel 1 is moved by hand from the extended position B2 shown in FIG. 12*b* toward the normal position B1, the coil spring 34 is elastically stretched and the latch hook 37 of the control member 36 is latched to the latching component 38, and as shown in FIG. 12*a*, the panel 1 is held at the normal position B1. When the panel 1 is to be moved from the normal position B1 to the extended position B2, the control member 36 is pushed up with a finger, unlatching the latch hook 37 and the latching component 38, and as shown in FIG. 12*b*, the panel 1 moves to the extended position B2 under the biasing force produced by the contraction of the coil spring 34.

Magnets 39 that attract each other, such as a magnetic catch, are provided to the convex component 32 of the linking member 31 and to the inner part of the concave component 33 so as to fix the panel 1 that has been moved to the extended position B2 to the unit main body 2 side.

Instead of latching the latch hook 37 and the latching component 38 as above, the locking mechanism G may be constituted such that magnets that attract each other, such as a magnetic catch, are provided to the panel 1 side and the linking member 31 side, allowing the panel 1 to be fixed in the normal position B1 by the attraction of these magnets.

The rest of the constitution is the same as in the third embodiment.

Fifth Embodiment

Figure 13:
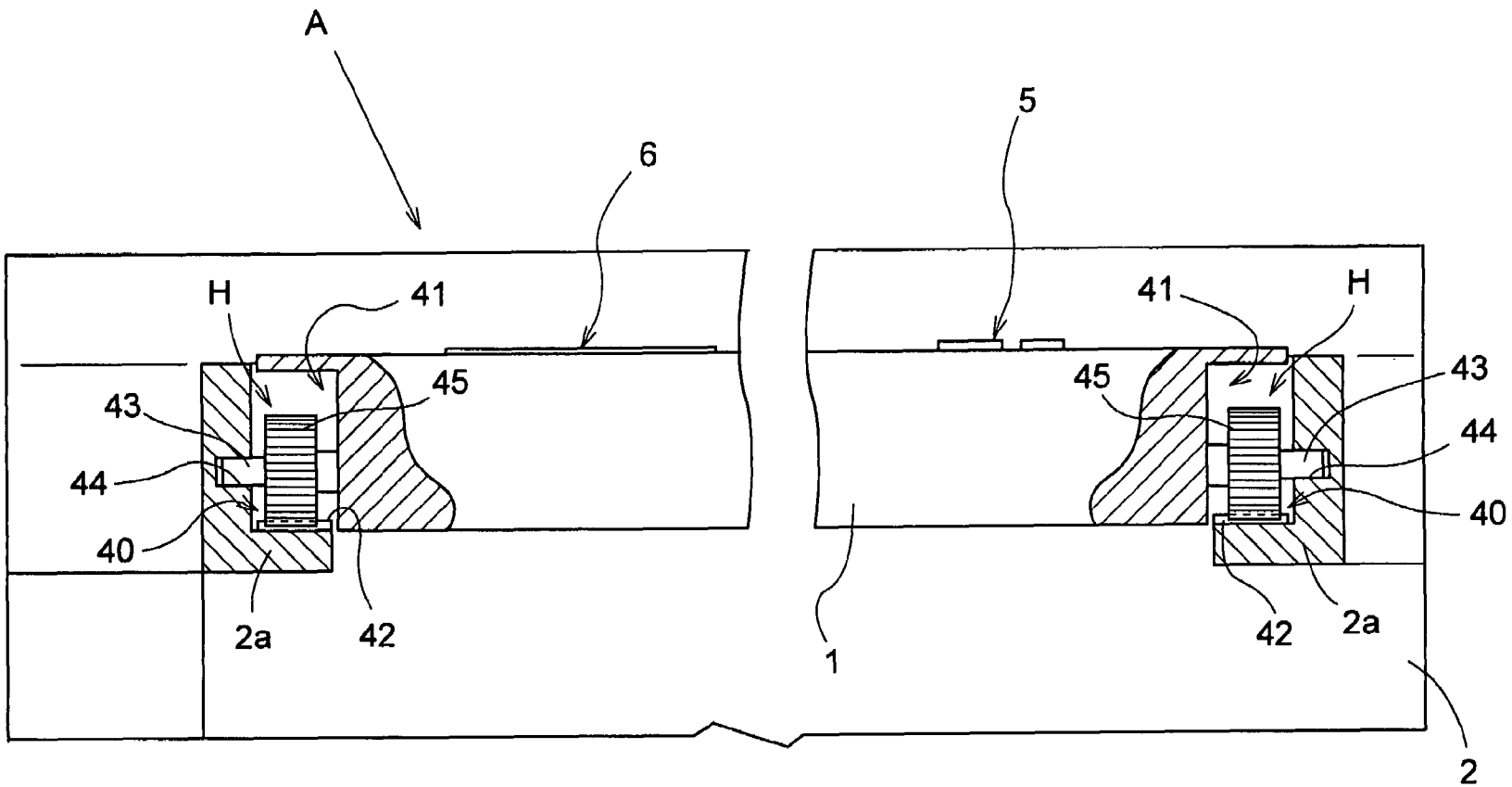
FIG. 13 is a partial cross sectional front view of the main components of the processing unit according to a fifth embodiment.
Figure 14:
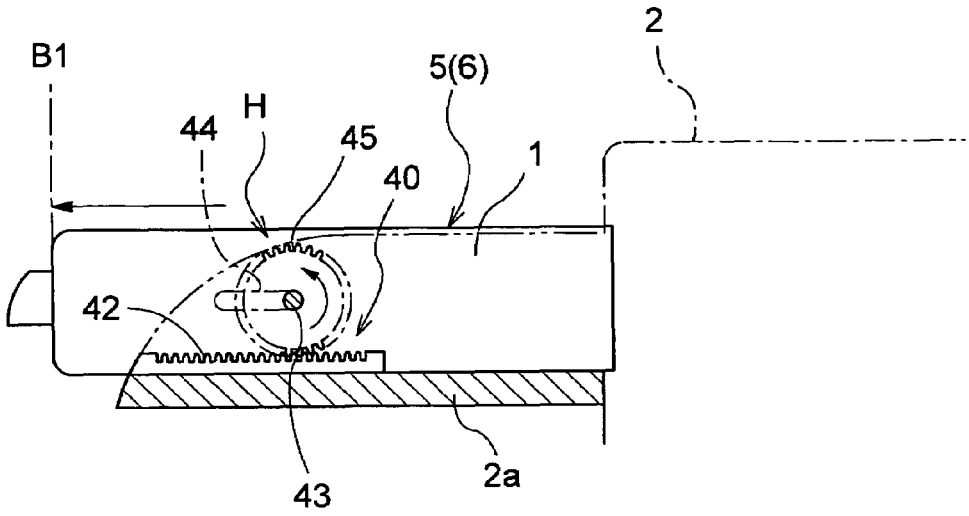
FIGS. 14*a* and 14*b* are partial cross sectional front views of the main components of the processing unit according to the fifth embodiment.
Figure 14:
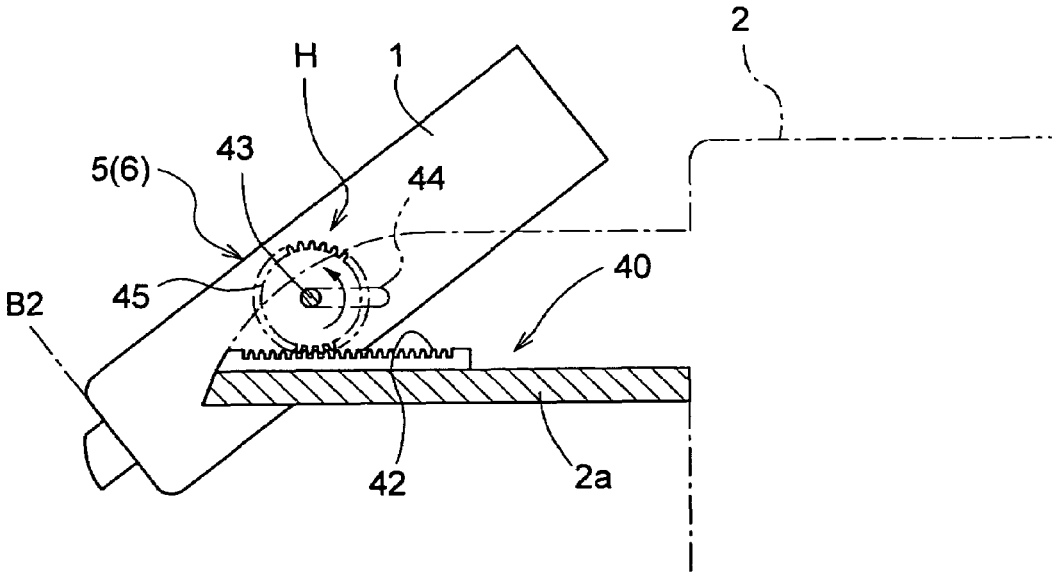

A fifth embodiment of the processing unit according to the present invention will now be described. FIGS. 13 and 14 are diagrams of the fifth embodiment of the processing unit according to the present invention. As shown in these drawings, the panel support mechanism C of the processing unit according to this embodiment is constituted such that the left and right sides of the panel 1 are supported so as to allow movement toward and away from the front side with respect to the unit main body 2, and support components 40 that provide vertically pivotable support are fixed to the unit main body 2. Also provided is a gear linking mechanism H that affords linkage such that the panel 1 pivots downward as it is moved toward the front side. Specifically, this gear linking mechanism H links the movement of the panel 1 toward the front side, with the changing of the control component 5 and the display component 6 from an upward orientation to a lateral orientation facing toward the front side.

As the support components 40, grooves 41 are provided parallel to each other in the fore and aft direction, with the open sides facing each other, to the left and right sides of the unit main body 2. Also, as the support components 40, rack gears 42 are provided facing upward on the inside of these grooves 41, and guide grooves 44 in which are fitted support shafts 43, which are fixed to the ends of the panel 1 in the left and right direction, are provided on the unit main body 2 side and parallel to the grooves 41. A finisher, job separator, or other such device is installed in a unit main body portion 2*a* located below the panel 1.

The gear linking mechanism H has the rack gears 42 provided in the grooves 41, and pinion gears 45 that are disposed inside the grooves 41 so as to mesh with the rack gears 42 and are integrally fixed coaxially with the support shafts 43 to the ends of the panel 1 in the left and right direction. The pinion gears 45 and the rack gears 42 mesh as the panel 1 moves along the guide grooves 44, and as a result, the panel 1 is supported so that it can move toward and away from the front side with respect to the unit main body 2, and is also hinged so as to be capable of pivoting up and down.

Therefore, when the panel 1 is moved from the normal position B1, in which it is retracted the farthest from the unit main body 2 side shown in FIG. 14*a*, toward the front side, the pinion gears 45 rotated along with the panel 1 around the support shafts 43, and as shown in FIG. 14*b*, the control component 5 and the display component 6 are changed from an upward orientation to a lateral orientation.

Also, as shown in FIG. 14*b*, when the panel 1 moves back toward the unit main body 2 side from the extended position B2 where it protrudes the farthest toward the front side with respect to the unit main body 2, the pinion gears 45 rotate in reverse along with the panel 1 around the support shafts 43, and as shown in FIG. 14*a*, the control component 5 and the display component 6 are changed from a lateral orientation to an upward orientation.

The rest of the constitution is the same as in the third embodiment.

Sixth Embodiment

Figure 15:
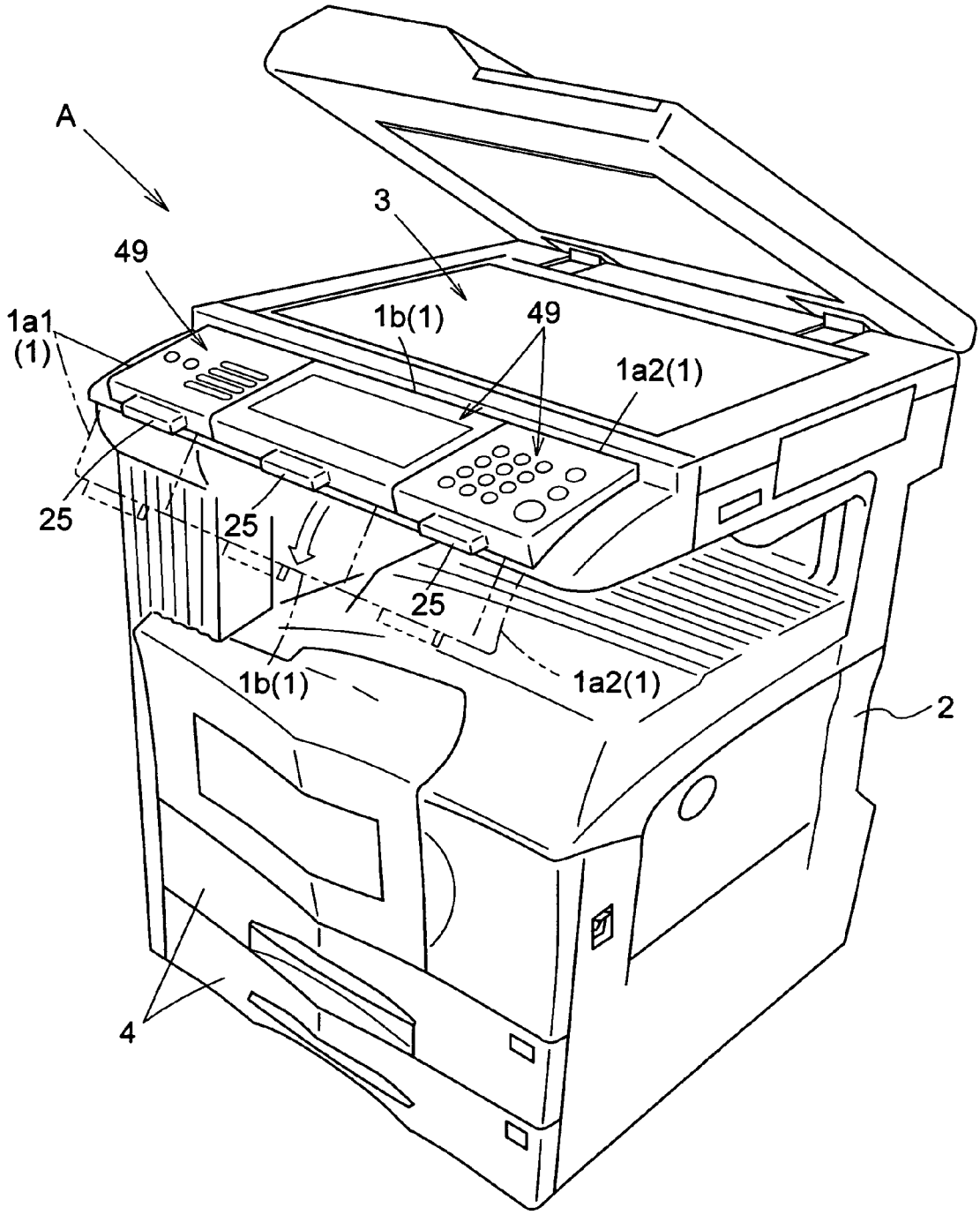
FIG. 15 is a perspective view of the processing unit according to a sixth embodiment.

A sixth embodiment of the processing unit according to the present invention will now be described. FIG. 15 is a perspective view of the processing unit according to the sixth embodiment of the present invention. In this embodiment, the present invention is applied to a copier, printer, fax machine, or other such image processing unit A as an example of a processing unit. With this image processing unit A, the panel 1 includes two control panels 1*a* consisting of a first control panel 1*a*1 and a second control panel 1*a*2 and equipped with a control component 5 for inputting commands in the execution of image processing, and one display panel 1*b* equipped with a display component 6 consisting of a liquid crystal display device or the like for displaying the processing status and other such information. These panels 1*a*1, 1*a*2, and 1*b* are each supported such that they can individually move and have their orientation changed with respect to the unit main body 2.

The unit main body 2 houses an image processor for performing image processing, an imaging component for forming images on a sheet material, and so forth. The control panels 1*a*, the display panel 1*b*, and a scanner 3 having a scanning function for reading documents are provided on the top side of the unit main body 2. A paper feed cassette 4 or the like for holding sheets for printing output is provided at the bottom part of the unit main body 2.

The control panels 1*a* comprise the first control panel 1*a*1, which is provided, for example, with setting keys for switching the image processing mode and so forth, and the second control panel 1*a*2, which is provided, for example, with a liquid crystal touch panel and input keys for inputting commands such as starting or stopping copying, canceling, etc. These control panels are disposed to the left and right of the display panel 1*b*. A liquid crystal touch panel may be provided to the display panel 1*b*.

Figure 16:
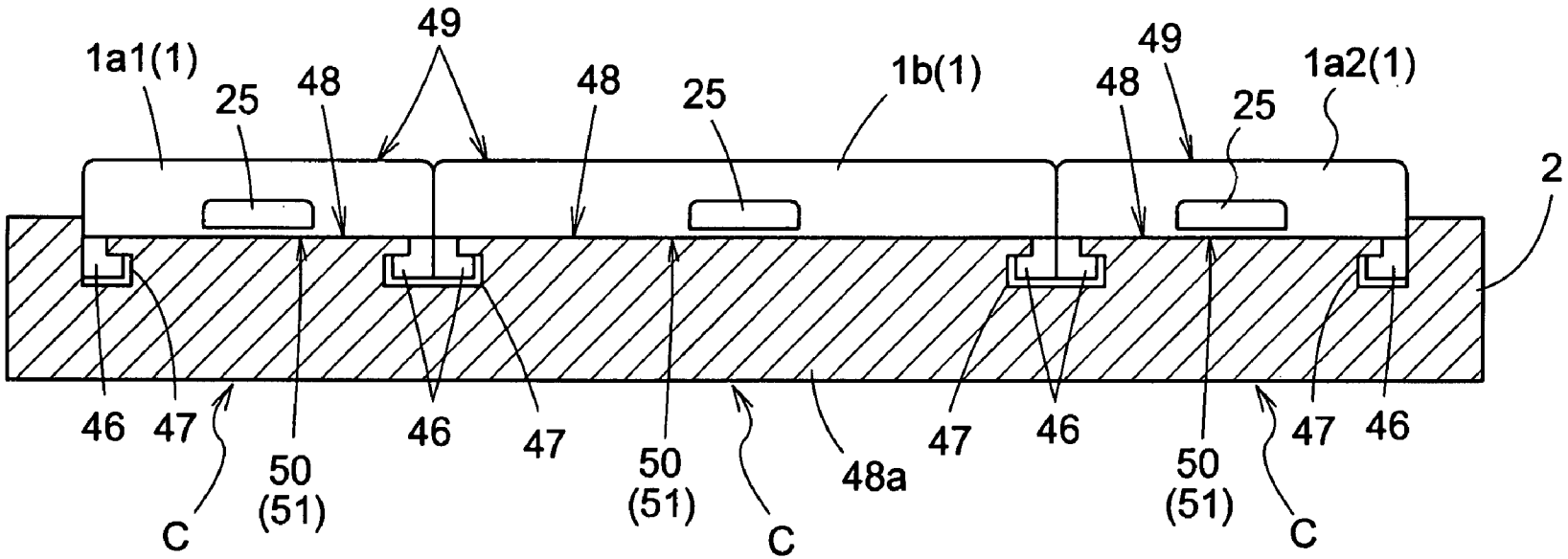
FIG. 16 is a cross sectional view of the main components of the processing unit according to the sixth embodiment.
Figure 17:
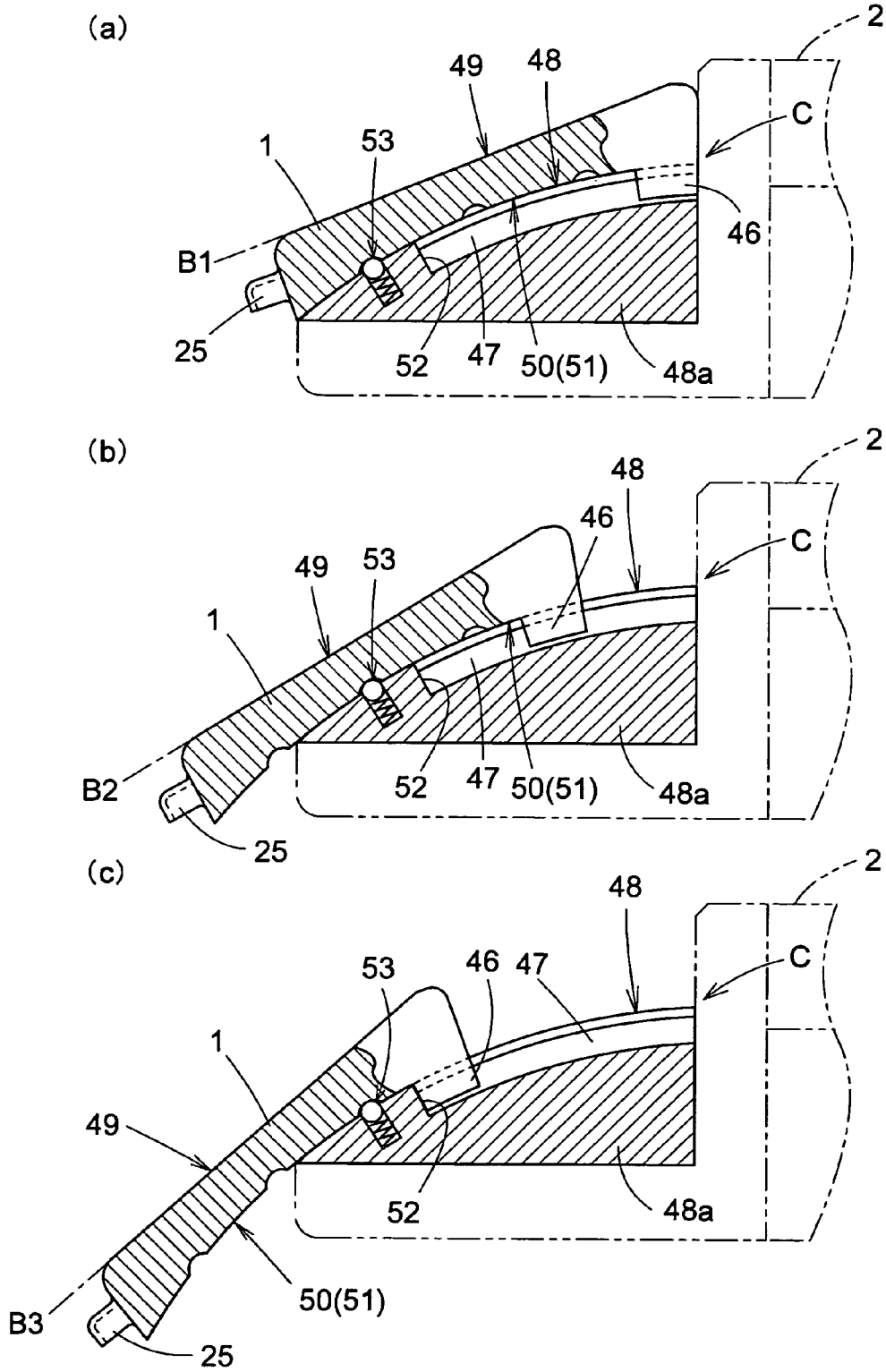
FIGS. 17*a* to 17*c* are cross sectional views of the main components of the processing unit according to the sixth embodiment.

The first control panel 1*a*1, the second control panel 1*a*2, and the display panel 1*b* are each supported by the panel support mechanism C so as to be individually capable of moving toward the front side with respect to the unit main body 2 (an example of the side with respect to the unit main body). More specifically, as shown in FIGS. 16 and 17, slide members 46 provided on the left and right sides of the lower surface of each of the panels 1*a*1, 1*a*2, and 1*b* are engaged in guide grooves 47 that are arc-shaped when viewed from the side and are formed in the fore and aft direction on the unit main body 2 side. The panel support mechanism C supports the panels 1*a*1, 1*a*2, and 1*b* such that each can be individually moved toward and away from the front side with respect to the unit main body 2 along the guide grooves 47 when a knob 25 provided to the front edge of the panels 1*a*1, 1*a*2, and 1*b* is grasped and pulled toward the front side.

Figure 18:
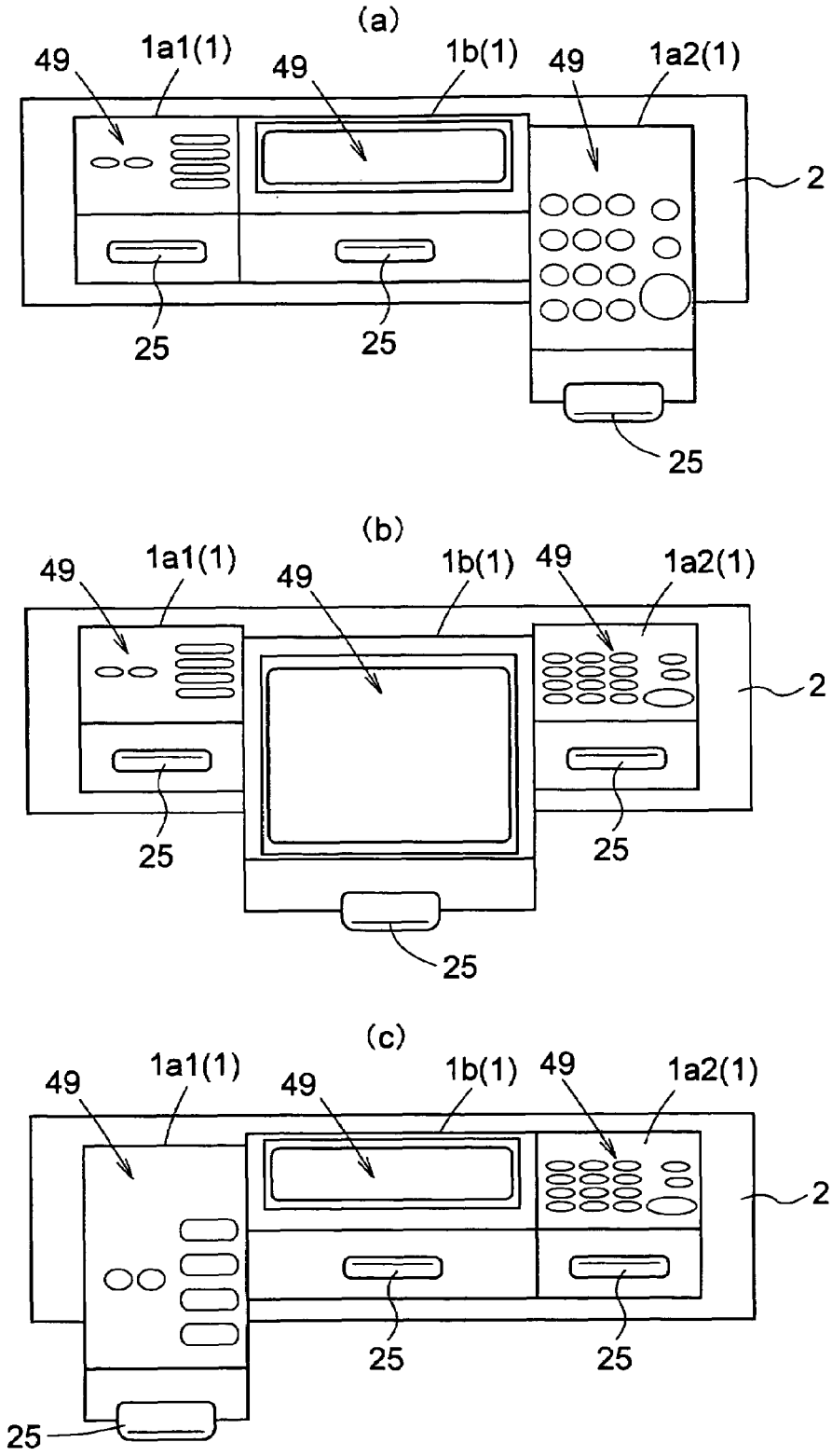
FIGS. 18*a* to 18*c* are diagrams (1) of how the processing unit according to the sixth embodiment is used.

As shown in FIGS. 18*a* to 18*c*, the panel support mechanism C is provided such that the first control panel 1*a*1, the second control panel 1*a*2, and the display panel 1*b* can each be individually extended to the front side and changed to a lateral orientation as needed. Specifically, the panel support mechanism C is reversibly operatably provided to each of the panels 1*a*1, 1*a*2, and 1*b* such that the panels 1*a*1, 1*a*2, and 1*b* can be individually changed, each in its entirety, from an upward orientation to a lateral orientation facing the front side, and can be lowered, in conduction with the movement of the panels 1*a*1, 1*a*2, and 1*b* toward the front side.

The panel support mechanism C has a guide surface 48 that is arc-shaped when viewed from the side and becomes lower in height (extends progressively lower) toward the front side, provided to the top part of the front side of the unit main body 2. The panel support mechanism C is constituted so as to support the panels 1*a*1, 1*a*2, and 1*b*, each in its entirety, such that these panels can slide back and forth, individually, toward and away from the front side with respect to the unit main body 2, along the guide surface 48 and the guide grooves 47. Also, each of the panels 1*a*1, 1*a*2, and 1*b* is shaped so as to have a substantially flat upper surface 49 on which the control component 5, the display component 6, and so forth are provided, and a lower surface 51 on which is formed a guided surface 50 with an arc shape having substantially the same curvature as the guide surface 48 when viewed from the side. The guided surfaces 50 of the panels 1*a*1, 1*a*2, and 1*b* are designed to be aligned with the guide surface 48.

A stopper 52 is provided at the front end of each of the guide grooves 47. As shown in FIG. 17*c*, when the slide members 46 hit the stopper 52, the panels 1*a*1, 1*a*2, and 1*b* are held in their maximum tilt position B3 at which the upper surfaces 49 are tilted the farthest toward the front side. An elastic latching mechanism 53, such as a ball detent, is provided removably with the movement of the panels 1*a*1, 1*a*2, and 1*b* to the left and right sides of the sliding components between the guide surface 48 and the guided surfaces 50. As a result, the panels 1*a*1, 1*a*2, and 1*b* can be held at their normal position B1 at which the upper surfaces 49 face upward the most, as shown in FIG. 17*a*, and at an intermediate position B2 midway between the normal position B1 and the maximum tilt position B3, as shown in FIG. 17*b*.

Therefore, in the normal position B1, as shown in FIG. 17*a*, the panels 1*a*1, 1*a*2, and 1*b* can be held at their highest position, and the upper surfaces 49 in their most upward-facing orientation. In the intermediate position B2, as shown in FIG. 17*b*, the panels 1*a*1, 1*a*2, and 1*b* can be held in their intermediate position within the range of fore and aft movement and the range of up and down movement (vertical movement range), with the upper surfaces 49 tilted somewhat more toward the front side than when in the normal position B1. In the maximum tilt position B3, the panels 1*a*1, 1*a*2, and 1*b* can be held in their lowest position, with the upper surfaces 49 tilted the most toward the front side.

Figure 19:
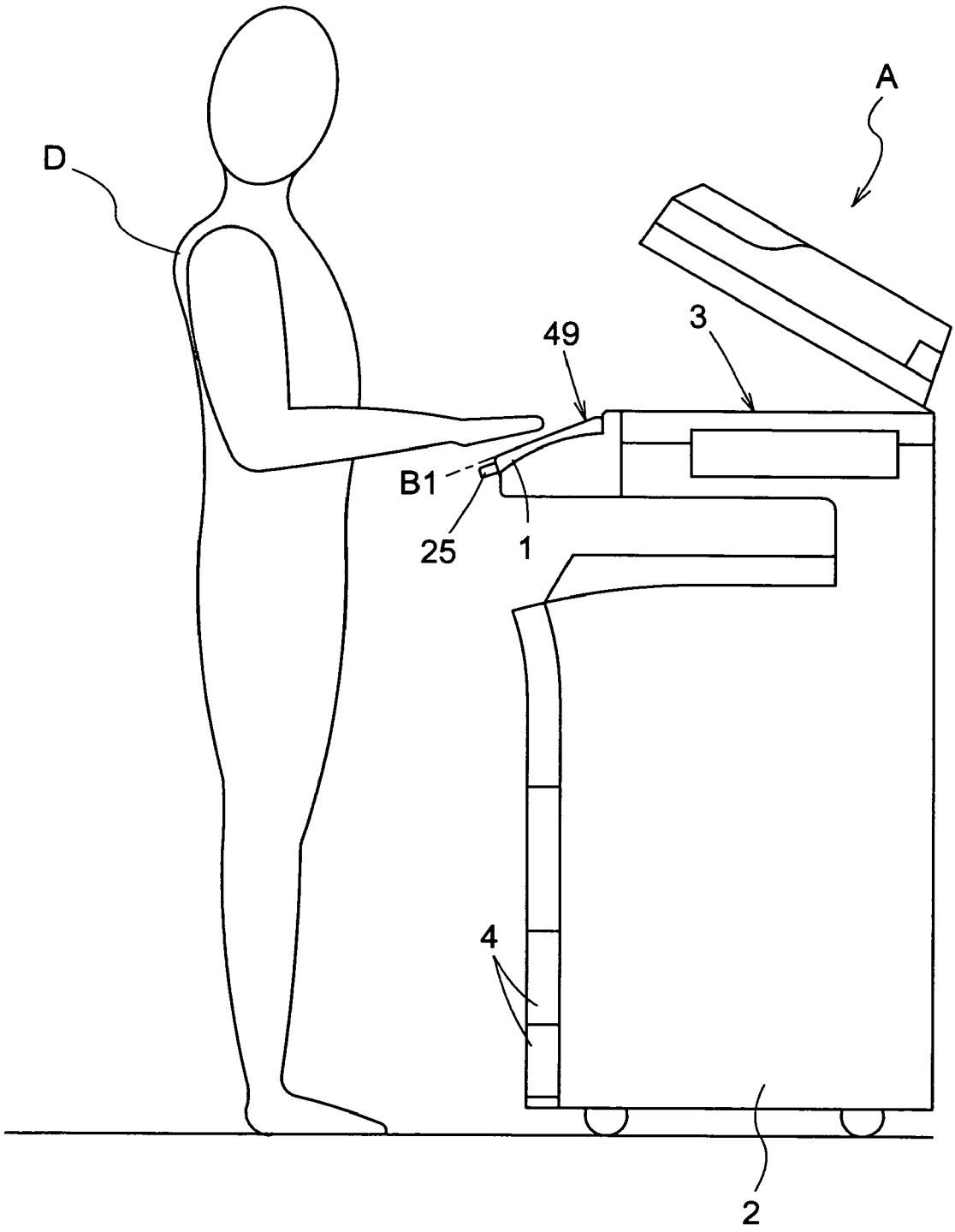
FIG. 19 is a diagram (2) of how the processing unit according to the sixth embodiment is used.
Figure 20:
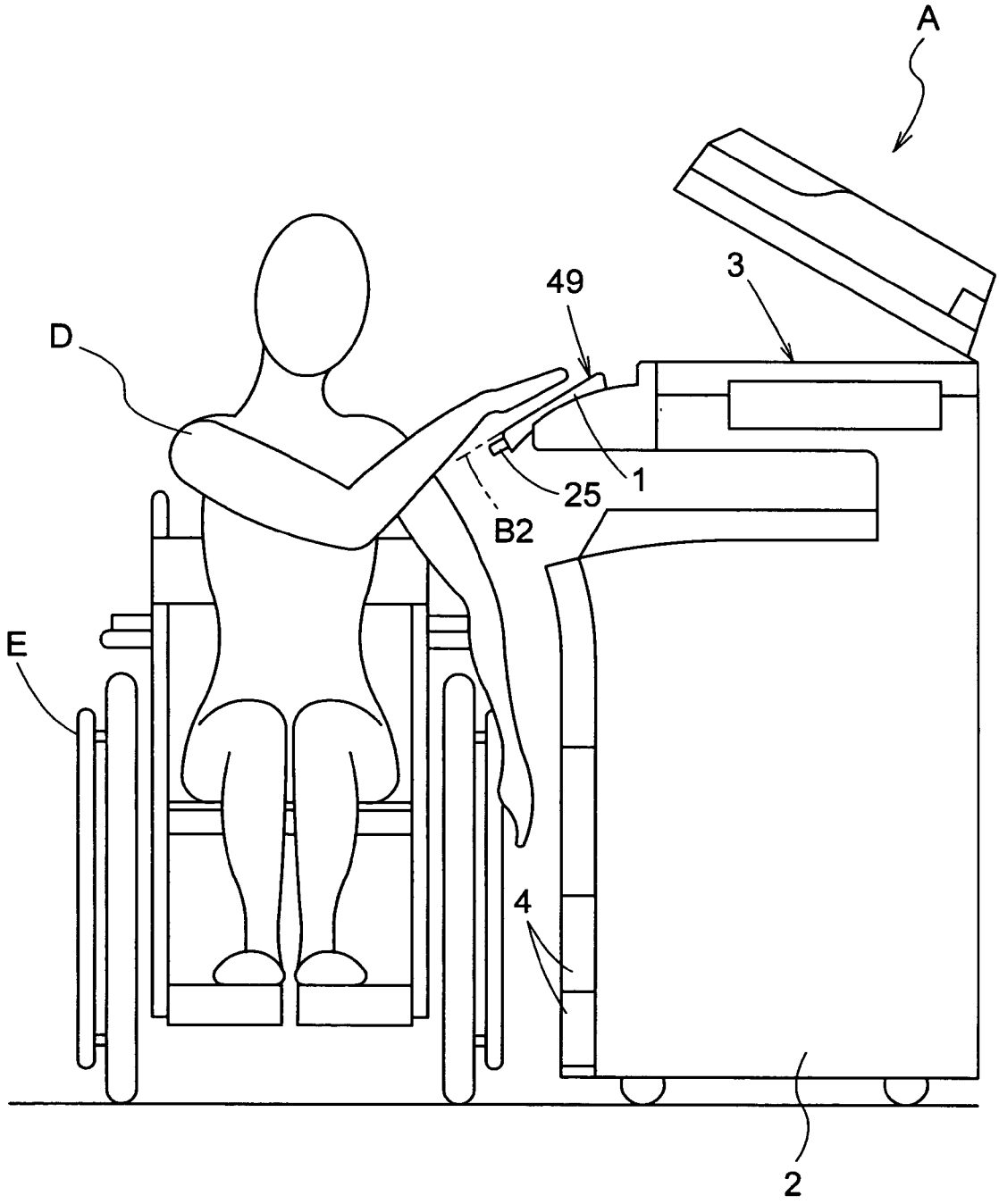
FIG. 20 is a diagram (3) of how the processing unit according to the sixth embodiment is used.
Figure 21:
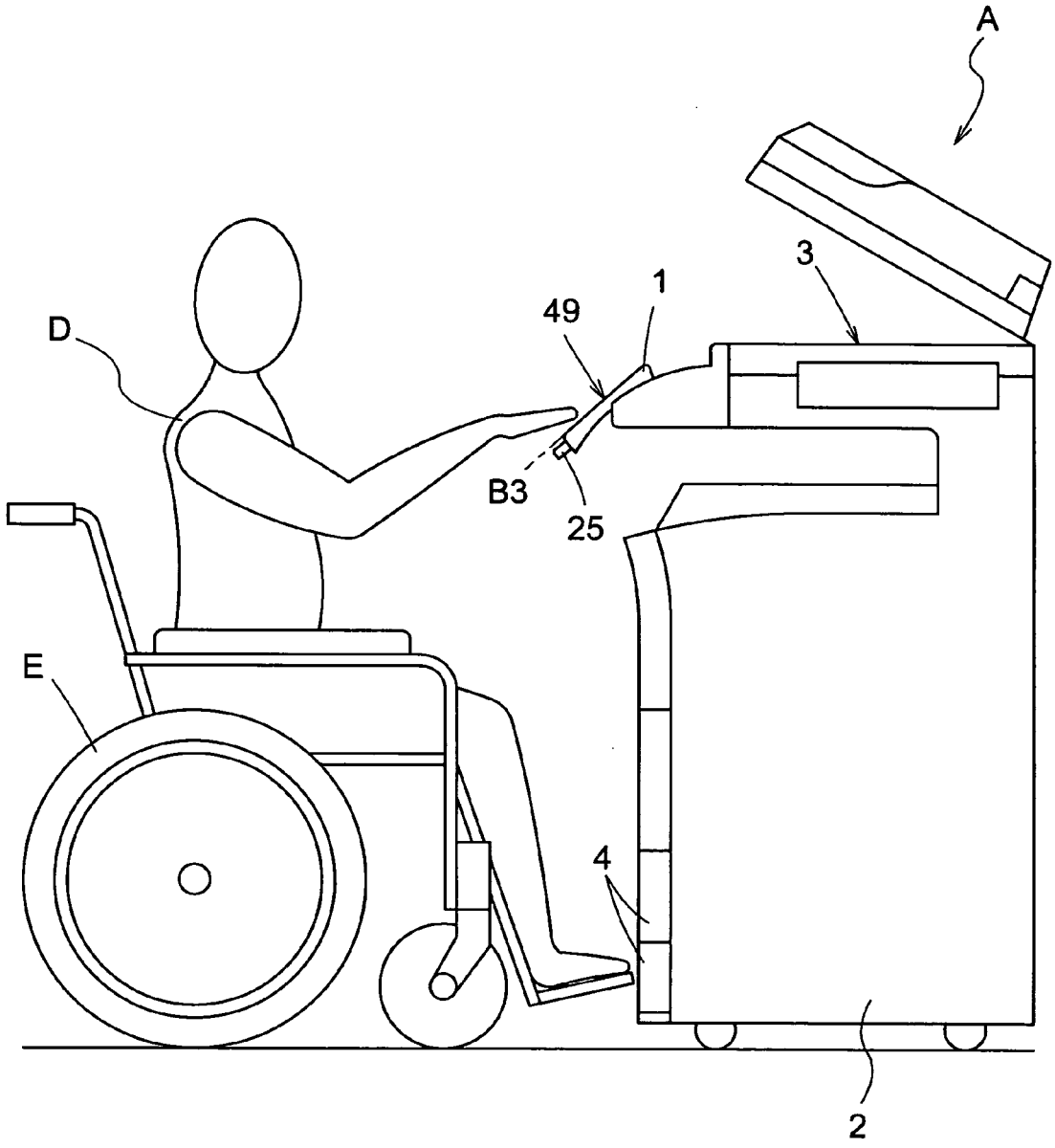
FIG. 21 is a diagram (4) of how the processing unit according to the sixth embodiment is used.

When the image processing unit A is constituted as above, if a user D is a person of average eye height, such as a healthy person not in a wheelchair E, as shown in FIG. 19, the panels 1*a*1, 1*a*2, and 1*b* can each be used while held at the normal position B1, at which the upper surfaces 49 are easier to see from a high position. If the user D is a person of lower eye height, such as a handicapped person in the wheelchair E, as shown in FIG. 20, when the wheelchair E is moved up sideways next to the front of the unit main body 2, the panels 1*a*1, 1*a*2, and 1*b* are each used from a relatively close position. In view of this, the panels 1*a*1, 1*a*2, and 1*b* can be used while held at the intermediate position B2, at which the upper surfaces 49 are easier to see when viewed from diagonally above at a lower position. When the wheelchair E is moved head-on up to the front of the unit main body 2, as shown in FIG. 21, the panels 1*a*1, 1*a*2, and 1*b* are used from a relatively distant position. In view of this, the panels 1*a*1, 1*a*2, and 1*b* can be used while held at the maximum tilt position B3, at which the upper surfaces 49 are easier to see when viewed from straight ahead at a low position.

Seventh Embodiment

Although not depicted in the drawings, in the sixth embodiment above, the panel support mechanism C can also be constituted such that whenever any of the first control panel 1*a*1, the second control panel 1*a*2, and the display panel 1*b* are moved toward the front side with respect to the unit main body (an example of the side with respect to the unit main body), some or all of the remaining panel or panels 1*a*1, 1*a*2, and 1*b* are changed, along with the panel or panels 1*a*1, 1*a*2, and 1*b* that have been moved, individually from an upward orientation to a lateral orientation facing the front side.

In this case, even when panels having different specifications, such as control functions or display functions, are used as the first control panel 1*a*1, the second control panel 1*a*2, and the display panel 1*b*, these panels 1*a*1, 1*a*2, and 1*b* can be individually incorporated. Also, the panels can be simply supported such that whenever any of the panels 1*a*1, 1*a*2, and 1*b* are moved toward the front side, some or all of the remaining panel or panels 1*a*1, 1*a*2, and 1*b* are changed along with the panel or panels 1*a*1, 1*a*2, and 1*b* that have been moved, individually from an upward orientation to a lateral orientation facing the front side.

Eighth Embodiment

Figure 22:
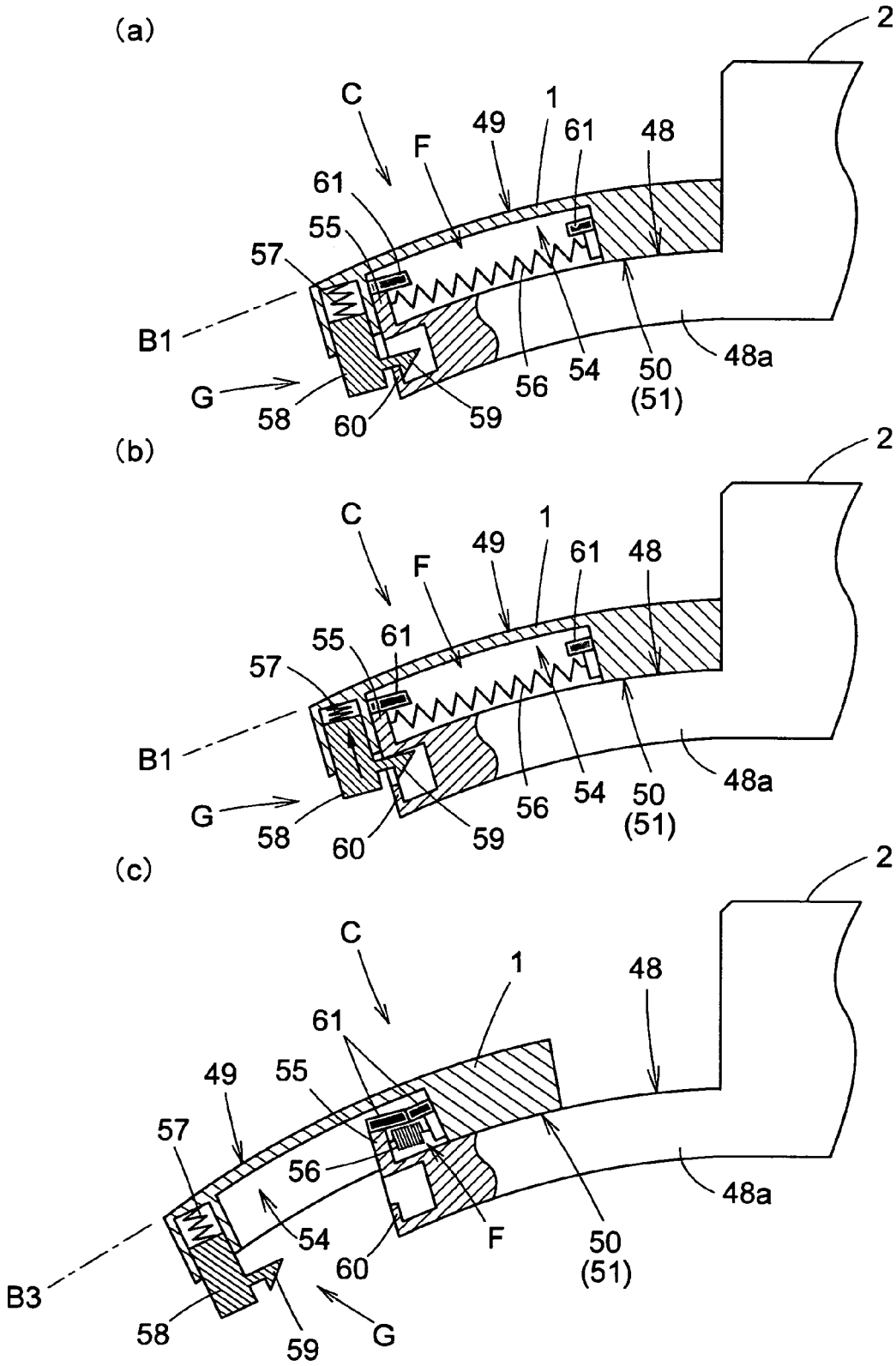
FIGS. 22*a* to 22*c* are diagrams of the processing unit according to an eighth embodiment.

An eighth embodiment of the processing unit according to the present invention will now be described. FIGS. 22*a* to 22*c* are diagrams of the eighth embodiment of the processing unit according to the present invention. As shown in FIGS. 22*a* to 22*c*, the panel support mechanism C has a biasing mechanism F for biasing the panels 1*a*1, 1*a*2, and 1*b* so as to move to the maximum tilt position B3, at which the panels 1*a*1, 1*a*2, and 1*b* protrude the farthest forward toward the front side with respect to the unit main body 2 (an example of the side with respect to the unit main body), with this biasing mechanism F disposed in a concave components 54 formed on the lower sides of the panels 1*a*1, 1*a*2, and 1*b*. The panel support mechanism C also has in the approximate center in the left-right direction of the panels 1*a*1, 1*a*2, and 1*b* a locking mechanism G capable of fixing each of the panels 1*a*1, 1*a*2, and 1*b* in the normal position B1 in which the panels are retracted the farthest from the front side with respect to the unit main body 2. As a result, the panels 1*a*1, 1*a*2, and 1*b* are each supported so as to be capable of moving to two positions: the normal position B1 and the maximum tilt position B3. In this embodiment, the panel support mechanism C is provided in each of the panels 1*a*1, 1*a*2, and 1*b*.

The biasing mechanism F is constituted such that a guide-side protrusion 55 provided to the front end of a guide member 48*a* so as to protrude upward above the guide surface 48, is linked by a coil spring 56 (an example of an elastic member) to the inner part of each concave component 54 of the panels 1*a*1, 1*a*2, and 1*b*. As a result, the panels 1*a*1, 1*a*2, and 1*b* that have moved to the maximum tilt position B3 shown in FIG. 22*c* stretch the coil springs 56 while moving to the normal position B1 shown in FIGS. 22*a* and 22*b*. The biasing force of the coil spring 56 allows the panels 1*a*1, 1*a*2, and 1*b* to return from the normal position B1 to the maximum tilt position B3.

The locking mechanism G has control members 58 that are supported by each of the panels 1*a*1, 1*a*2, and 1*b* in a state of being able to move up and down, and is biased downward by a spring 57. The locking mechanism G also comprises latch hooks 59 of the control members 58 that are pushed in when the panels 1*a*1, 1*a*2, and 1*b* have been moved to the normal position B1, and latching components 60 capable of latching so as to obstruct the movement of the panels 1*a*1, 1*a*2, and 1*b* to the maximum tilt position B3, and provided at the front end of the guide member 48*a*.

When the panels 1*a*1, 1*a*2, and 1*b* are moved by hand from the maximum tilt position B3 toward the normal position B1, the coil spring 56 is elastically stretched and the latch hook 59 of the control member 58 is latched to the latching component 60, and as shown in FIG. 22*a*, the panels 1*a*1, 1*a*2, and 1*b* are each held at the normal position B1. When the panels 1*a*1, 1*a*2, and 1*b* are to be moved from the normal position B1 to the maximum tilt position B3, as shown in FIG. 22*b*, the control member 58 is pushed up with a finger, unlatching the latch hook 59 and the latching component 60, and as shown in FIG. 22*c*, the panels 1*a*1, 1*a*2, and 1*b* each move to the maximum tilt position B3 under the biasing force produced by the contraction of the coil spring 56.

Magnets 20 that attract each other, such as a magnetic catch, are provided to the guide-side protrusions 55 and inner parts of the concave components so as to fix the panels 1*a*1, 1*a*2, and 1*b* that have been moved to the maximum tilt position B3 to the unit main body 2 side.

Instead of latching the latch hook 59 and the latching component 60 as above, the locking mechanism G may be constituted such that magnets 20 that attract each other, such as a magnetic catch, are provided to each of the panels 1*a*1, 1*a*2, and 1*b* side and the unit main body 2 side, allowing the each of panels 1*a*1, 1*a*2, and 1*b* to be fixed in the normal position B1 by the attraction of these magnets.

The rest of the constitution is the same as in the sixth embodiment.

Ninth Embodiment

Figure 23:
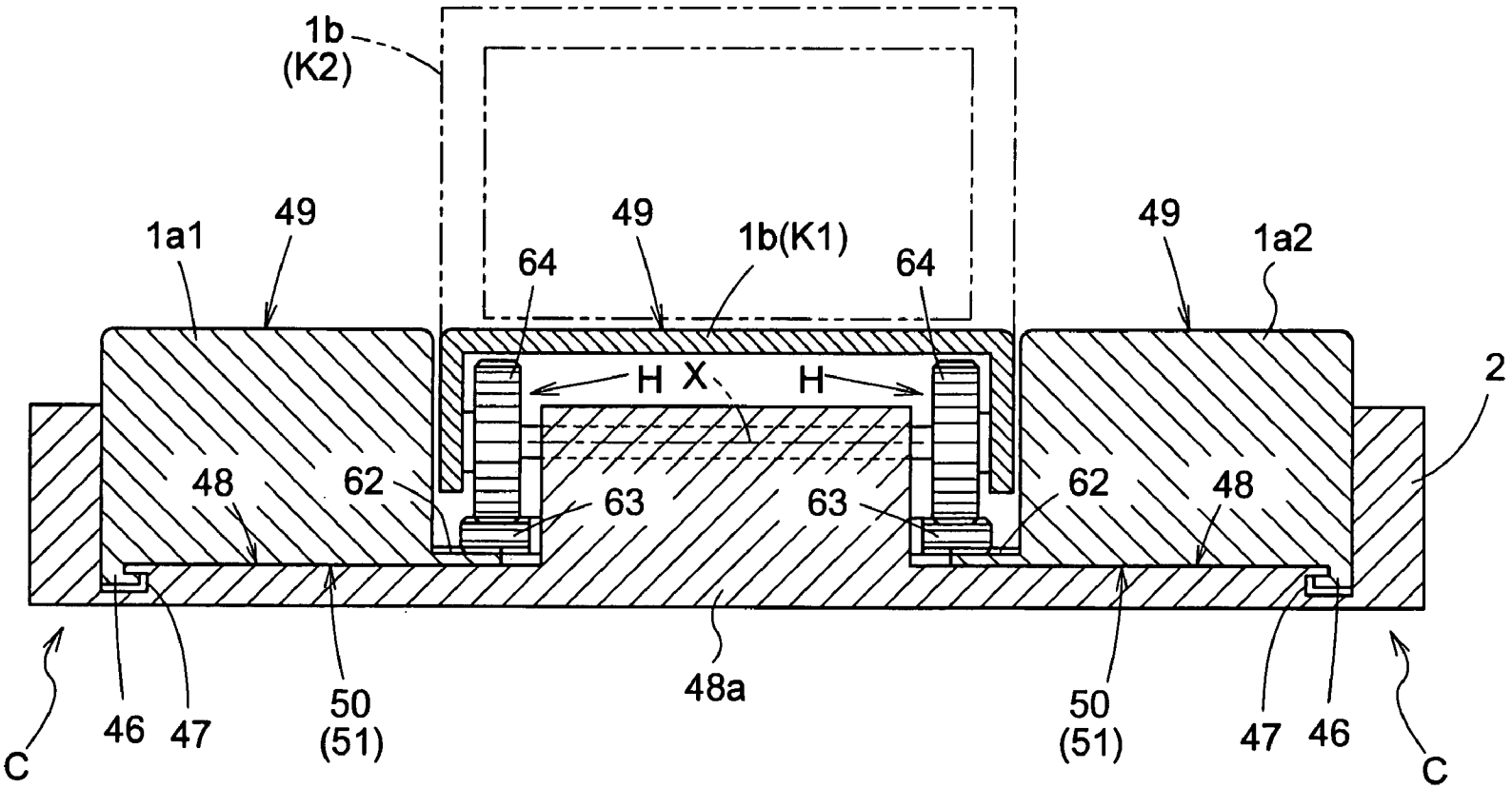
FIG. 23 is a cross sectional view of the main components of the processing unit according to a ninth embodiment.
Figure 24:
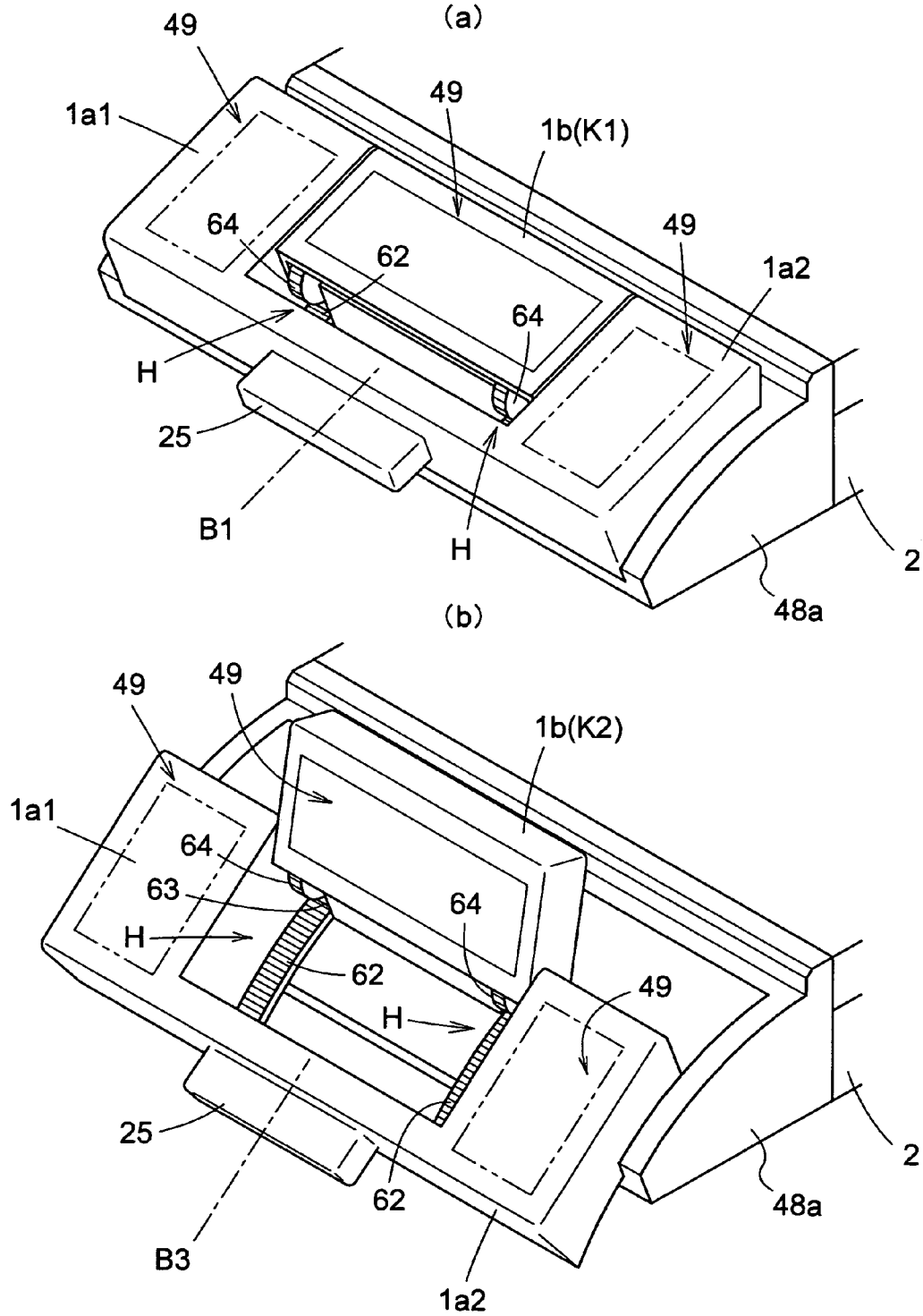
FIGS. 24*a* and 24*b* are diagrams of the processing unit according to the ninth embodiment.

A ninth embodiment of the processing unit according to the present invention will now be described. FIGS. 23 and 24 are diagrams of the ninth embodiment of the processing unit according to the present invention. As shown in these drawings, in this embodiment, the control panel 1*a* is formed in a U-shape in plan view, in which the first control panel 1*a*1 and the second control panel 1*a*2 are integrally linked at the front side of the panels. Also, as shown in FIG. 23, slide members 46 provided on the left and right sides on the lower surface of the control panel 1*a* are engaged with guide grooves 47 that are arc-shaped when viewed from the side and are formed in the fore and aft direction on the unit main body 2 side. The panel support mechanism C supports the control panel 1*a* such that it can be moved toward and away from the front side with respect to the unit main body 2 along the guide grooves 47 when a knob 25 provided to the front edge of the control panel 1*a* is grasped and pulled toward the front side with respect to the unit main body 2 (an example of the side with respect to the unit main body). Also, the panel support mechanism C supports a display panel 1*b* disposed in between the first control panel 1*a*1 and the second control panel 1*a*2, such that it can be moved toward and away from the front side around a lateral axis X on the unit main body 2 side.

The panel support mechanism C is provided such that the control panel 1*a* and the display panel 1*b* can each be changed from an upward orientation to a lateral orientation facing the front side in conjunction with the movement of the control panel 1*a* toward the front side, or in conjunction with the pivoting of the display panel 1*b* toward the front side.

The panel support mechanism C has a gear linking mechanism H that is provided on the left and right sides of the display panel 1*b* and links the movement of the control panel 1*a* toward the front side with the pivoting of the display panel 1*b* toward the front side. As a result, the display panel 1*b* is provided such that its lateral orientation facing the front side can be greater than that of the control panel 1*a*.

The gear linking mechanism H has rack gears 62 provided along the mutually opposing ends of the first control panel 1*a*1 and the second control panel 1*a*2 in the control panel 1*a* with the display panel 1*b* sandwiched in between. Also, the gear linking mechanism H has pinion gears 63 that are supported on the guide member 48*a* side and mesh with the rack gears 62, and gears 64 that are provided integrally to the display panel 1*b* and mesh with the pinion gears 63 and thereby rotate around the lateral axis X (the pivot axis).

With the above constitution, the movement operation whereby the control panel 1*a* is extended toward the front side and/or the pivot operation whereby the display panel 1*b* is pivoted toward the front side results in the control panel 1*a* at the normal position B1 and the display panel 1*b* in the normal orientation K1 moving from their positions shown in FIG. 24*a*, that is, the control panel 1*a* moves to the maximum tilt position B3 and the display panel 1*b* moves to the maximum tilt orientation K2, as shown in FIG. 24*b*. Also, the movement operation whereby the control panel 1*a* is moved toward the rear side and/or the pivot operation whereby the display panel 1*b* is pivoted toward the rear results in the control panel 1*a* at the maximum tilt position B3 and the display panel 1*b* in the maximum tilt orientation K2 moving from their positions shown in FIG. 24*b*, that is, the control panel 1*a* moves to the normal position B1 and the display panel 1*b* moves to the normal orientation K1, as shown in FIG. 24*a*.

The rest of the constitution is the same as in sixth embodiment.

OTHER EMBODIMENTS

1. The processing unit according to the present invention may be constituted such that a panel support mechanism supports a panel so that the control component and/or the display component is changed from an upward orientation to a lateral orientation in conjunction with the movement of the panel (each panel when there are a plurality of panels) in the fore and aft direction, the left and right direction, diagonally, or any other direction toward the side with respect to the unit main body.
2. The processing unit according to the present invention may be constituted such that the panel support mechanism has an electric or hydraulic drive unit for driving the panel so that the control component and/or the display component is changed from an upward orientation to a lateral orientation, or is changed from a lateral orientation to an upward orientation.
3. The processing unit according to the present invention may be constituted such that the panel support mechanism has link mechanism for supporting the panel so that the control component and/or the display component can be changed from an upward orientation to a lateral orientation in conjunction with movement of the panel in the fore and aft direction, the left and right direction, diagonally, or any other direction toward the side with respect to the unit main body.
4. The processing unit according to the present invention may be constituted such that the panel support mechanism separately has a panel movement unit and an orientation changing unit for changing the orientation of a control component and/or a display component, or a panel equipped with these, and as the panel moves toward the side with respect to the unit main body, the movement unit and the orientation changing unit are driven so that the control component and/or the display component is changed from an upward orientation to a lateral orientation.
5. The processing unit according to the present invention may be constituted such that the panel support mechanism supports the panel so that the control component and/or the display component is changed from an upward orientation to a lateral orientation in stages in conjunction with the movement of the panel toward the side with respect to the unit main body.
6. The processing unit according to the present invention may be constituted such that the panel support mechanism is provided so that the panel can be held at any intermediate position within its movable range.
7. The processing unit according to the present invention may be constituted such that the panel support mechanism is provided so that the control component and/or the display component can be held at any intermediate position within its movable range.
8. The processing unit according to the present invention may be constituted such that the panel support mechanism supports the panel so that in conjunction with the movement of the panel toward the side with respect to the unit main body, the control component and/or the display component is tilted at the point when the panel reaches a specific position, and the orientation is changed to a lateral orientation corresponding to this specific position.

9. The processing unit according to the present invention may be constituted such that the control component and/or the display component is supported by the panel such that the orientation can be changed from an upward orientation to a lateral orientation, and the panel support mechanism supports the panel so that the control component and/or the display component is changed from an upward orientation to a lateral orientation with respect to the panel in conjunction with the movement of the panel toward the side with respect to the unit main body.

10. With the processing unit according to the present invention, the angle at which the control component and/or the display component is changed from an upward orientation to a lateral orientation may be 90 degrees or greater, and this orientation change angle may correspond to the panel attachment position or the environment in which the panel is to be used.

11. The processing unit according to the present invention may be constituted such that the panel support mechanism has a roller or the like between its guide surface and the guided surface on the panel, and the panel is supported so that it can slide along the guide surface.

12. The processing unit according to the present invention may be constituted such that the panel support mechanism has a biasing mechanism for biasing the panel to move to the normal position at which it is retracted the farthest from the front side with respect to the unit main body, and a locking mechanism capable of fixing the panel in the maximum tilt position in which it is extended farthest toward the front side with respect to the unit main body. In this case, when the panel is moved by hand against the biasing force from its normal position toward the maximum tilt position, the locking mechanism fixes the panel in this maximum tilt position and holds it there. When the panel is to be moved from the maximum tilt position to the normal position, the latching of the locking mechanism is released, and the panel moves to the normal position under the biasing force of the biasing mechanism.

13. The processing unit according to the present invention may be constituted such that if the panel support mechanism supports the control panel and the display panel so that they can move and be reoriented separately, then the panel support mechanism has a biasing mechanism for biasing the display panel to pivot to its normal orientation facing upward on the unit main body, and a locking mechanism capable of fixing the display panel in the maximum tilt orientation in which it is inclined the farthest toward the front side with respect to the unit main body. In this case, when the normally-biased display panel is pivoted by hand against the biasing force to the maximum tilt orientation, the locking mechanism fixes the display panel in this maximum tilt orientation and holds it that way. When the display panel is to be pivoted from its maximum tilt orientation to its normal orientation, the latching of the locking mechanism is released, and the display panel pivots to the normal orientation under the biasing force of the biasing mechanism.

14. The processing unit according to the present invention may be constituted such that if the panel support mechanism supports the control panel and the display panel so that they can move and be reoriented separately, then the panel support mechanism has a biasing mechanism for biasing the display panel to pivot to its maximum tilt orientation in which it is tilted farthest toward the front side with respect to the unit main body, and a locking mechanism capable of fixing the display panel in the normal orientation in which it faces upward on the unit main body. In this case, when the display panel in its maximum tilt orientation is pivoted by hand against the biasing force to the normal orientation, the locking mechanism fixes the display panel in this normal orientation and holds it that way. When the display panel is to be pivoted from its normal orientation to its maximum tilt orientation, the latching of the locking mechanism is released, and the display panel pivots to the maximum tilt orientation under the biasing force of the biasing mechanism.

15. The processing unit according to the present invention may be provided with magnets that attract each other, such as a magnetic catch, are provided to the panel side and the unit main body side, allowing the panel to be fixed in the desired position or orientation. Also, a link-type latching mechanism for latching the panel to the unit main body may be releasably provided.

16. The processing unit according to the present invention may be constituted such that when a locking mechanism for fixing the panel is provided, the fixing produced by the locking mechanism is released as a knob provided to the panel is grasped and pushed or pulled.

17. The processing unit according to the present invention may be constituted such that a panel equipped only with a control panel is supported.

18. The processing unit according to the present invention may be constituted such that a panel equipped only with a display panel is supported.

19. The processing unit according to the present invention may be an image processing unit equipped with a plurality of functions, such as a copying function, printing function, and fax function.

20. The processing unit according to the present invention may be any of various kinds of electrical device, machine tool, driving device, or the like in which a panel equipped with a control component and/or a display component is supported movably with respect to a unit main body.

What is claimed is:

1. A processing unit, comprising:

a unit main body;

a panel equipped with a control component and/or a display component mounted along a surface thereof; and a panel support mechanism for supporting the panel such that the control component and/or display component can change from an upward orientation to a lateral orientation facing to a side with respect to the unit main body in conjunction with a projecting movement of the panel toward said side.

2. The processing unit according to claim 1, wherein the panel support mechanism supports the panel such that the control component and/or display component can change continuously from the upward orientation to the lateral orientation in conjunction with the projecting movement of the panel toward said side.

3. The processing unit according to claim 1, wherein the panel support mechanism supports the panel such that the panel moves downward in conjunction with the projecting movement of the panel toward said side.

4. The processing unit according to claim 1, wherein the panel support mechanism supports the panel such that the panel is able to slide toward said side, the sliding movement of the panel to project toward said side is mechanically linked with the change in orientation of the control component and/or display component, and moving the panel to project toward said side changes the control component and/or display component from the upward orientation to the lateral orientation.

5. The processing unit according to claim 4, wherein for the mechanical link between the sliding movement and the change in orientation, the panel support mechanism supports the panel such that the panel can slide along an arc-shaped guide surface which extends progressively lower toward said side.

6. A processing unit, comprising:

a unit main body;

a panel equipped with a control component and/or a display component; and a gear linking mechanism that links the movement of the panel to a side with respect to the unit main body with the change in orientation of the control component and/or display component from an upward orientation to a lateral orientation facing toward said side, the change in orientation being a different movement to the movement of the panel.

7. A processing unit, comprising:

a unit main body;

a panel equipped with a control component and/or a display component;

a gear linking mechanism that links the movement of the panel to a side with respect to the unit main body with the change in orientation of the control component and/or display component from an upward orientation to a lateral orientation facing toward said side, and a support member that is vertically pivotably attached to the unit main body and movably supports the panel, wherein the gear linking mechanism is constituted such that the support member pivots downward as the panel moves toward said side.

8. A processing unit, comprising:

a unit main body;

a panel equipped with a control component and/or a display component;

a gear linking mechanism that links the movement of the panel to a side with respect to the unit main body with the change in orientation of the control component and/or display component from an upward orientation to a lateral orientation facing toward said side, and a support component that is fixed to the unit main body and that movably and vertically pivotably supports the panel, wherein the gear linking mechanism is constituted such that the panel pivots downward as the panel moves toward said side.

9. A processing unit, comprising:

a unit main body;

a control panel equipped with a control component and a display panel equipped with a display component; and a panel support mechanism that supports the control panel and the display panel individually and movably toward a side with respect to the unit main body, and individually supports the control panel and the display panel such that they can be separately changed from an upward orientation to a lateral orientation facing toward said side in conjunction with the movement toward said side.

10. A processing unit, comprising:

a unit main body;

a control panel equipped with a control component and a display panel equipped with a display component; and a panel support mechanism that supports the control panel movably toward a side with respect to the unit main body, supports the display panel pivotably toward said side, and individually supports the control panel and the display panel such that they can be separately changed from an upward orientation to a lateral orientation facing toward said side in conjunction with the movement of the control panel toward said side, or with the pivoting of the display panel toward said side.

11. The processing unit according to claim 10, wherein the panel support mechanism is constituted such that the display panel can be changed to a lateral orientation that faces more toward said side than the control panel.

12. A processing unit, comprising:

a unit main body;

a control panel equipped with a control component and a display panel equipped with a display component; and a panel support mechanism that individually supports the control panel and the display panel movably toward a side with respect to the unit main body, and individually supports the control panel and the display panel such that they can be separately changed from an upward orientation to a lateral orientation facing toward said side in conjunction with the movement of either the control panel or the display panel toward said side.

* * * * *